US010065819B2

(12) United States Patent
Shoji et al.

(10) Patent No.: US 10,065,819 B2
(45) Date of Patent: Sep. 4, 2018

(54) IMAGE FORMING APPARATUS AND FEEDING DEVICE

(71) Applicant: CANON KABUSHIKI KAISHA, Tokyo (JP)

(72) Inventors: Ryuhei Shoji, Mishima (JP); Yuta Hojo, Suntou-gun (JP); Shingo Harada, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/457,870

(22) Filed: Mar. 13, 2017

(65) Prior Publication Data

US 2017/0269533 A1 Sep. 21, 2017

(30) Foreign Application Priority Data

Mar. 18, 2016 (JP) ..... 2016-055762

(51) Int. Cl.
*B65H 5/00* (2006.01)
*B65H 3/06* (2006.01)
(Continued)

(52) U.S. Cl.
CPC ..... *B65H 3/0669* (2013.01); *B65H 1/14* (2013.01); *B65H 3/0607* (2013.01); *B65H 7/12* (2013.01);
(Continued)

(58) Field of Classification Search
CPC ..... B65H 3/06; B65H 3/0607; B65H 3/0669; B65H 3/0684; B65H 3/60; B65H 5/06;
(Continued)

(56) References Cited

U.S. PATENT DOCUMENTS 5,969,371 A 10/1999 Andersen
2013/0342602 A1* 12/2013 Yamagata ..... B41J 13/26 347/16
(Continued)

FOREIGN PATENT DOCUMENTS

CN 101021696 A 8/2007
JP H11-236146 A 8/1999
(Continued)

*Primary Examiner* — Prasad V Gokhale
(74) *Attorney, Agent, or Firm* — Canon U.S.A., Inc. IP Division

(57) ABSTRACT

An image forming apparatus includes feeding, conveying, and separating members, and detecting, image forming, and control units. The feeding member feeds a recording material placed on a tray. The separating member and the conveying member separate recording materials at a nip. The detecting unit detects that the recording materials have been fed to the nip. The image forming unit forms an image on fed recording material. The control unit switches between a first and second control. Under the first control, the feeding member starts feeding a recording material placed on the tray, and ends feeding before a recording material trailing end passes through the feeding member. Under the second control, the feeding member starts feeding a recording material placed on the tray, and ends feeding after a recording material trailing end passes through the feeding member when the detection unit detects that the recording materials are fed to the nip.

31 Claims, 16 Drawing Sheets

(51) Int. Cl.
*G03G 15/00* (2006.01)
*B65H 1/14* (2006.01)
*B65H 7/12* (2006.01)

(52) U.S. Cl.
CPC ..... *G03G 15/6529* (2013.01); *B65H 2301/42324* (2013.01); *B65H 2404/14* (2013.01); *B65H 2801/12* (2013.01)

(58) Field of Classification Search
CPC ... B65H 7/00; B65H 7/02; B65H 7/06; B65H 7/12; B65H 7/125; B65H 7/14; B65H 7/18; B65H 7/20; B65H 2513/50; B65H 2513/51; B65H 2513/511; B65H 2513/512
See application file for complete search history.

(56) References Cited

U.S. PATENT DOCUMENTS

| | | | | |
|---|---|---|---|---|
| 2015/0217957 | A1* | 8/2015 | Watanabe ..... | B65H 7/02 271/110 |
| 2016/0152425 | A1* | 6/2016 | Inoue ..... | B65H 3/06 271/10.03 |

FOREIGN PATENT DOCUMENTS

| | | | |
|---|---|---|---|
| JP | 2001072268 | A | 3/2001 |
| JP | 200499212 | A | 4/2004 |
| JP | 2004323143 | A | 11/2004 |
| JP | 2007197180 | A | 8/2007 |
| JP | 2014177326 | A | 9/2014 |
| WO | 2011007406 | A1 | 1/2011 |

* cited by examiner

IMAGE FORMING APPARATUS AND FEEDING DEVICE

BACKGROUND OF THE INVENTION

Field of the Invention

The present disclosure relates to an image forming apparatus such as a copier and a printer and a feeding device used in the apparatus and executing a feed control over a recording material therein.

Description of the Related Art

Conventionally, an image forming apparatus such as a copier and a printer has a cassette detachably attached to a main body of the image forming apparatus. Recording materials may be set in the cassette so that the recording materials can be fed sequentially to the main body of the image forming apparatus.

FIGS. 16A to 16E are sectional views of a cassette 10 according to International Publication No. WO/2011/007406. FIG. 16A illustrates a state that a plurality of recording materials S is set in the cassette 10. After a pickup roller 20 picks a first recording material S1, a feed roller 30 feeds the recording material S1 to a downstream side, as illustrated in FIG. 16B. According to International Publication No. WO/2011/007406, even after a rear end of the recording material S1 passes through the pickup roller 20, the pickup roller 20 keeps rotating. This then feeds a second recording material S2 simultaneously with the operation for feeding the recording material S1, as illustrated in FIG. 16C. A retard roller 40 and the feed roller 30 construct a separation nip Pfr which separates one from the plurality of recording materials S. Thus, as illustrated in FIG. 16D, when a leading end of the recording material S2 reaches the separation nip Pfr, the recording material S2 stops. The recording material S1 is only fed to the downstream side by the feed roller 30, and the operation for feeding the recording material S1 ends in the state as illustrated in FIG. 16E.

According to International Publication No. WO/2011/007406, it is controlled such that the position of the leading end of the recording material S2 taken out by an effect of friction and moving in an unintended direction in a range Ld illustrated in FIG. 16E can be adjusted to fit to the separation nip Pfr. The range Ld here is a range from an initial leading-end position Ps of a recording material S set in the cassette 10 to the separation nip Pfr. This control can reduce the distance (also called a sheet interval) between the rear end of the recording material S1 and the leading end of the recording material S2 and can increase the productivity of the image forming apparatus.

However, when the cassette 10 is drawn out in the state illustrated in FIG. 16E in order to replace the recording materials S accommodated in the cassette 10, there is a risk that the recording material S2 moving out from the cassette 10 may be wrinkled or folded or that the recording material S2 may be torn. Furthermore, because the recording material S2 is nipped by the feed roller 30 and the retard roller 40, there is a possibility that the recording material S2 may remain in the main body of the image forming apparatus when the cassette 10 is drawn out. If a user inserts the cassette 10 without noticing the presence of the recording material S2 remaining in the main body, the recording material S2 is jammed between the cassette 10 and the main body, which may prevent the image forming operation from starting.

SUMMARY OF THE INVENTION

An aspect of the present invention can provide an image forming apparatus and a feeding device which can prevent reduction of productivity and can protect accommodated recording materials from being damaged.

According to an aspect of the present invention, an image forming apparatus includes a feeding member configured to feed a recording material placed on a tray, a conveying member configured to convey the recording material fed by the feeding member, a separating member configured to form a nip with the conveying member and separate a plurality of recording materials at the nip, a detecting unit configured to detect that the plurality of recording materials has been fed to the nip, an image forming unit configured to form an image on the recording material fed from the tray, and a control unit configured to switch between a first control and a second control, wherein, under the first control, the feeding member starts feeding a recording material placed on the tray, and the feeding operation by the feeding member is ended before a trailing end of the recording material passes through the feeding member, and, wherein, under the second control, the feeding member starts feeding a recording material placed on the tray, and the feeding operation by the feeding member is ended after a trailing end of the recording material passes through the feeding member in a condition that the detection unit detects that the plurality of recording materials is fed to the nip.

Further features of the present invention will become apparent from the following description of embodiments with reference to the attached drawings.

DESCRIPTION OF THE EMBODIMENTS

First Embodiment

Description of Configuration of Image Forming Apparatus

Figure 1:
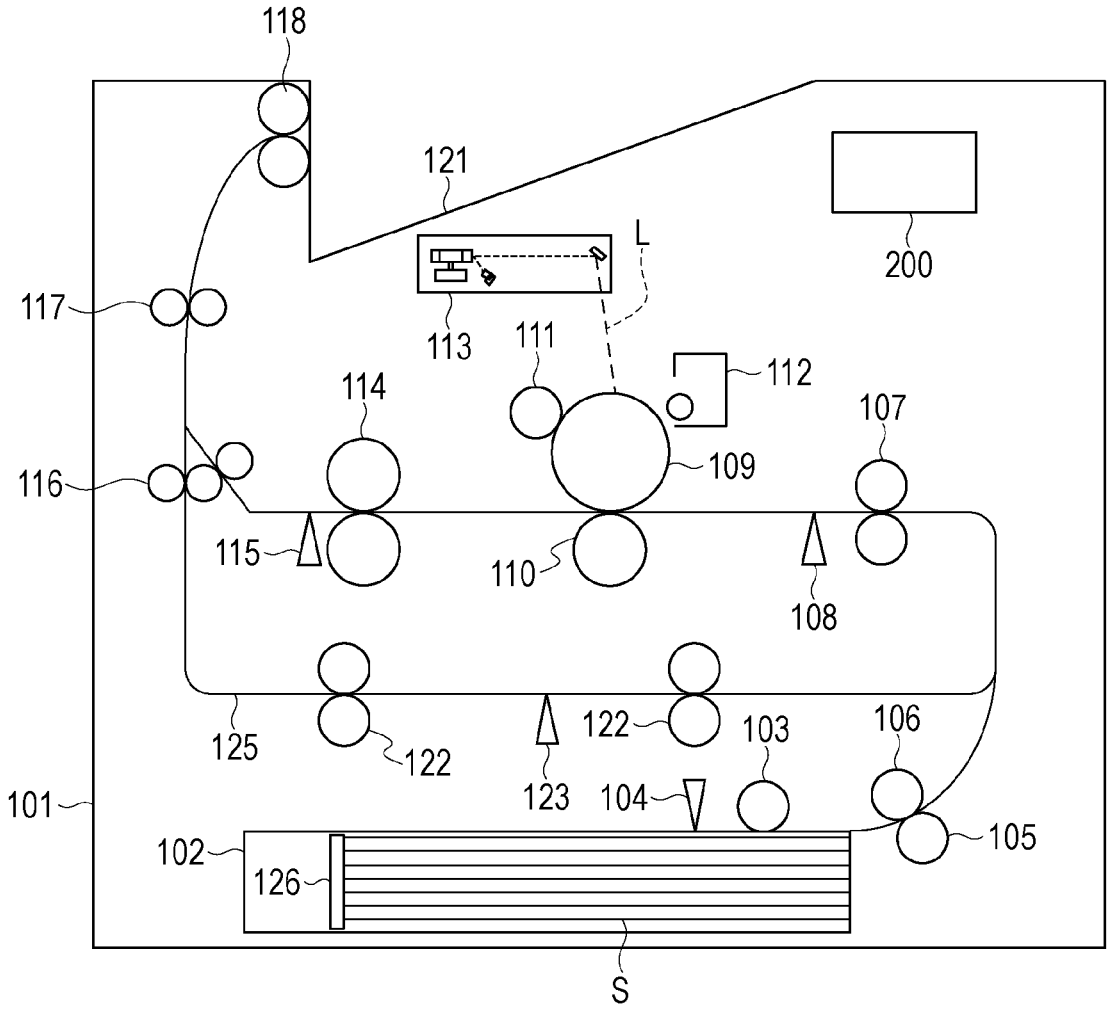
FIG. 1 is a schematic configuration diagram illustrating an image forming apparatus.

According to a first embodiment, an electrophotographic laser beam printer 101 (hereinafter, called a printer 101) is applied as an image forming apparatus. FIG. 1 is a schematic configuration diagram of the printer 101.

A cassette 102 is an accommodation unit configured to accommodate sheets S (recording materials) and may be detachably attached to a main body of the printer 101. In other words, the cassette 102 is a tray on which sheets S are placed. The cassette 102 has a rear-end regulating plate 126 which is configured to regulate rear ends (upstream ends in a feeding direction) of the sheets S accommodated in the cassette 102 and set the sheets S at a proper position. With the cassette 102 attached to the main body of the printer 101, a pickup roller 103 (feeding member) (hereinafter, called a pick roller 103) feeds a sheet S accommodated in the cassette 102. The sheet S fed by the pick roller 103 is conveyed to the further downstream side by a feed roller 106 (conveying member) and reaches a top sensor 108 through a registration roller pair 107. A separation roller 105 (separating member) and the feed roller 106 construct a separation nip which is configured to prevent a plurality of (or two or more) sheets S from being fed to a downstream side of the separation nip. Operations of the separation roller 105 will be described in detail below. Thus, a sheet S positioned at the top in a perpendicular direction of the sheets S accommodated in the cassette 102 can only be fed to the registration roller pair 107.

A sheet S detected by the top sensor 108 (recording material detecting unit) is then conveyed to an image forming unit. The image forming unit includes a photosensitive drum 109 (image carrier), a charging roller 111, a laser scanner 113 (exposing unit), a developing device 112, a transfer roller 110, and a fixing device 114 (fixing unit). The photosensitive drum 109 is uniformly charged by the charging roller 111 and is then irradiated with laser light L by the laser scanner 113 so that an electrostatic latent image can be formed on its surface. The thus formed electrostatic latent image can be visualized as a toner image by using toner supplied to the developing device 112. The photosensitive drum 109 and the transfer roller 110 construct a transfer nip, and a sheet S is conveyed to the transfer nip in synchronization with a rotation of the photosensitive drum 109. A toner image formed on the photosensitive drum 109 is transferred to the sheet S in the transfer nip. In order to transfer a toner image, voltage having an opposite polarity of that of the toner image is applied to the transfer roller 110. The sheet S to which the toner image has been transferred is conveyed to the fixing device 114 and is heated and is pressurized therein. As a result, the toner image transferred to the sheet S is fixed to the sheet S. The sheet S on which the toner image has been fixed is conveyed by a triple roller 116, an intermediate discharge roller 117, and a discharge roller 118 and is discharged to the sheet discharge tray 121. A series of printing operations ends up to this point.

In order to perform printing on both sides of a sheet S, the sheet S having one side printed is not discharged to the sheet discharge tray 121, but, after the rear end (the trailing end) of the sheet S passes through the triple roller 116, the triple roller 116, the intermediate discharge roller 117, and the discharge roller 118 are reversely rotated. The sheet S is then conveyed to a both-surface convey path 125 and is further conveyed to the image forming unit again by a both-surface feeding roller 122. Thus, printing can be performed on both sides of the sheet S.

Referring to FIG. 1, a discharge sensor 115 and a both-surface conveyance sensor 123 are provided for judging whether the sheet S is normally being conveyed or not. A sheet presence detection sensor 104 is provided for detecting whether a sheet S is accommodated in the cassette 102 or not.

Figure 2:
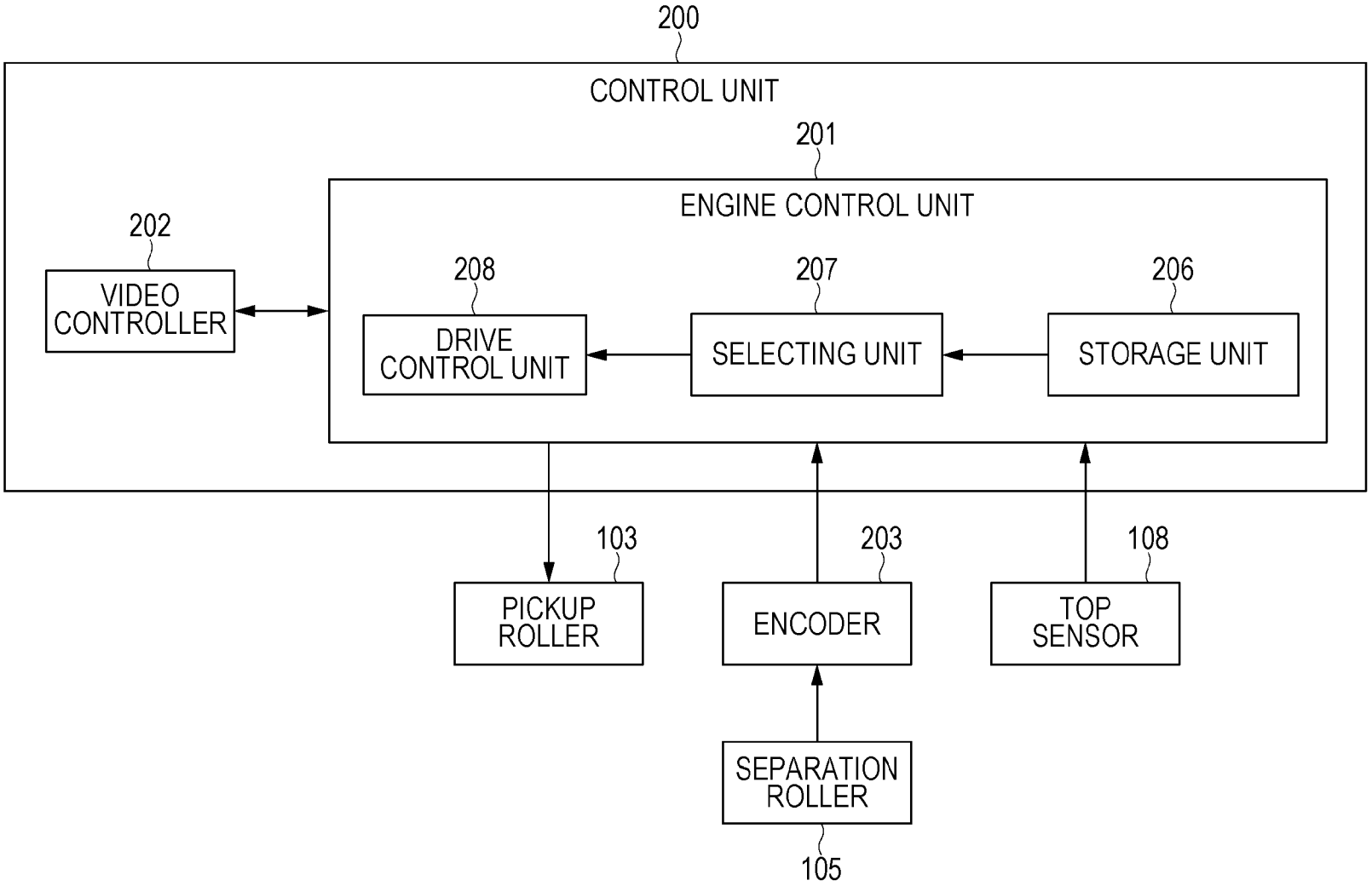
FIG. 2 is a control block diagram illustrating the image forming apparatus.

FIG. 2 is a block diagram illustrating a control unit 200 in the printer 101. The control unit 200 includes an engine control unit 201 and a video controller 202 which communicate with each other to execute the printing operation as described above. In response to a print instruction notified from an external apparatus, not illustrated, the video controller 202 analyzes image data, and the engine control unit 201 controls a mechanism of the printer 101 in accordance with a result of the analysis. The engine control unit 201 has a storage unit 206, a selecting unit 207, and a drive control unit 208. The storage unit 206 stores information regarding a print request notified from the video controller 202. The selecting unit 207 is configured to select one of two sheet feeding controls, which will be described below, based on the information regarding the print request stored in the storage unit 206. The drive control unit 208 is configured to control boot and stop of the sheet feeding mechanism in accordance with a sheet feeding control selected by the selecting unit 207.

An encoder 203 (rotation detecting unit) and a top sensor 108 are connected to the engine control unit 201 and are configured to detect a rotation state of the separation roller 105. Detection results from these sensors are used by the drive control unit 208 for controlling driving of the pick roller 103. Here, the encoder 203 may be a code wheel provided coaxially with the separation roller 105, for example. Alternatively, an optical rotary encoder, a magnetic rotary encoder, or a photo-interrupter, for example, may be applied in accordance with the required accuracy and a location where it is placed.

Description of First Sheet Feeding Control

Next, two sheet feeding controls according to this embodiment will be described. First of all, a first sheet feeding control will be described with reference to FIGS. 3A to 3D and FIG. 4.

Figure 3A:
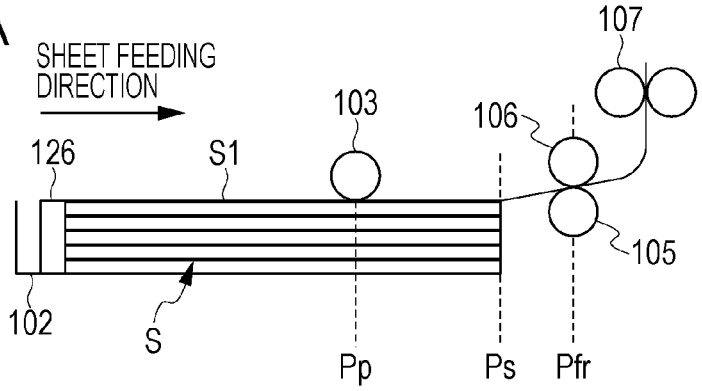
FIGS. 3A to 3D illustrate operations of a first sheet feeding control.
Figure 4:
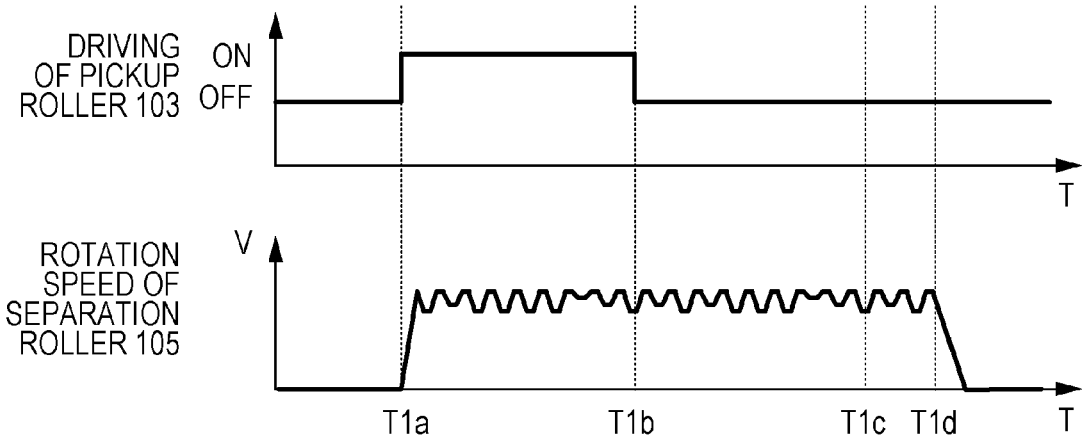
FIG. 4 is a timing chart when the first sheet feeding control is executed.

FIG. 3A illustrates a sectional view of the cassette 102 at a time point when a sheet S1 positioned at the top of sheets accommodated in the cassette 102 is fed. When the first sheet feeding control is started, the pick roller 103, the feed roller 106, and the separation roller 105 rotate, and the sheet S1 is fed to the right direction (sheet feeding direction) in FIG. 3A. FIG. 4 illustrates a graph having a horizontal axis indicating elapsed times and vertical axes indicating ON/OFF states of the driving of the pick roller 103 and rotation speeds V of the separation roller 105 where a time point T1*a* corresponds to the state illustrated in FIG. 3A. At the time point T1*a*, the driving of the pick roller 103 is shifted from an OFF state to an ON state so that the separation roller 105 starts rotating. Referring to FIG. 3A, Ps indicates a position of a leading end of a sheet S positioned by the rear-end regulating plate 126. The term "leading end" of a sheet S refers to an end on the downstream side in the sheet feeding direction of the sheet S. Pp indicates a position where the pick roller 103 nips the sheet S. Pfr indicates a position of a separation nip including the feed roller 106 and the separation roller 105.

The separation roller 105 is driven in a direction which prevents feeding of the sheet S (or a counterclockwise direction in FIG. 3A) and has a torque limiter, not illustrated. Here, when the feed roller 106 starts rotating in the direction that the sheet S is fed (or the counterclockwise direction in FIG. 3A), the separation roller 105 is operated by the torque limiter in the following manner. First, in a case where no sheet S is present in the separation nip, the separation roller 105 is rotated by the feed roller 106 in the direction that the sheet S is fed (clockwise direction in FIG. 3A) because of a setting that the force produced by friction with the feed roller 106 and received by the separation roller 105 is larger than a rotational load of the torque limiter. When one sheet S is conveyed to the separation nip, the separation roller 105 is rotated by the sheet S in the direction that the sheet S is fed because of a setting that the force produced by friction produced with the one sheet S and received by the separation roller 105 and is larger than a rotational load of the torque limiter. On the other hand, the rotational load of the torque limiter is set to be greater than a force for conveying two or more sheets S to the separation nip. Thus, the separation roller 105 may stop because the conveyance force and the rotational load are equally matched or start rotating in the direction that the sheet feeding is prevented because of the larger rotational load of the torque limiter, that is, in the direction opposite against the direction that the sheet S is fed.

Figure 3B:
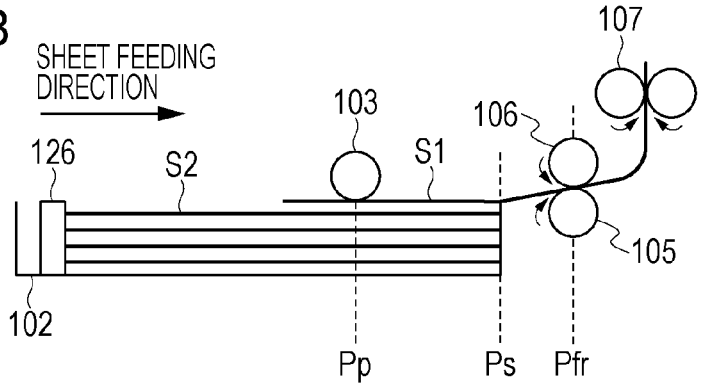

Next, FIG. 3B illustrates a sectional view of the cassette 102 at a time point immediately before a rear end of the sheet S1 (an upstream end in the sheet feeding direction) passes through the position Pp of the nip of the pick roller 103. Under the first sheet feeding control, because a sheet S2 positioned under the sheet S1 is not to be fed with the sheet S1 over the sheet S2, the driving of the pick roller 103 is turned off at this time point. The sheet S1 is further conveyed to the downstream side by the registration roller pair 107. After the driving is turned off, the pick roller 103 is rotated with conveyance of the sheet S1 and does not hinder the conveyance of the sheet S1. A feeding roller, not illustrated, for conveying a sheet S may further be provided between the registration roller pair 107 and the feed roller 106. The graph in FIG. 4 illustrates a time point T1*b* corresponding to the state illustrated in FIG. 3B. At the time point T1*b*, the driving of the pick roller 103 is shifted from an ON state to an OFF state, and the separation roller 105 rotates by following the sheet S1 that is being conveyed.

Figure 3C:
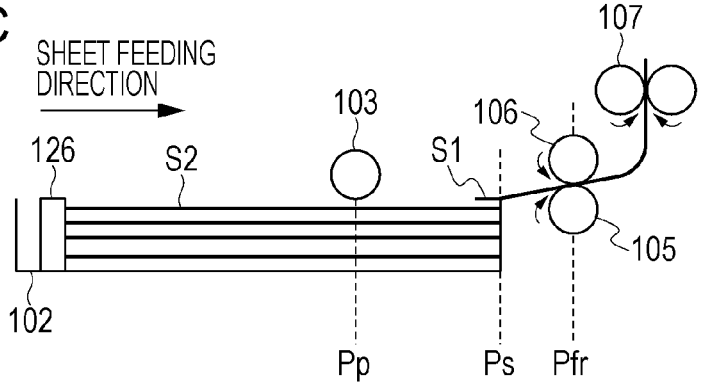

Next, FIG. 3C illustrates a sectional view of the cassette 102 at a time point immediately before the rear end of the sheet S1 passes through the position Pfr of the separation nip constructed by the feed roller 106 and the separation roller 105. Because the driving of the pick roller 103 has already been turned off, the position of the leading end of the sheet S2 does not change from Ps. The graph in FIG. 4 illustrates a time point T1*c* corresponding to the state illustrated in FIG. 3C. At the time point T1*c*, the separation roller 105 keeps rotating by following the sheet S1 that is being conveyed.

Figure 3D:
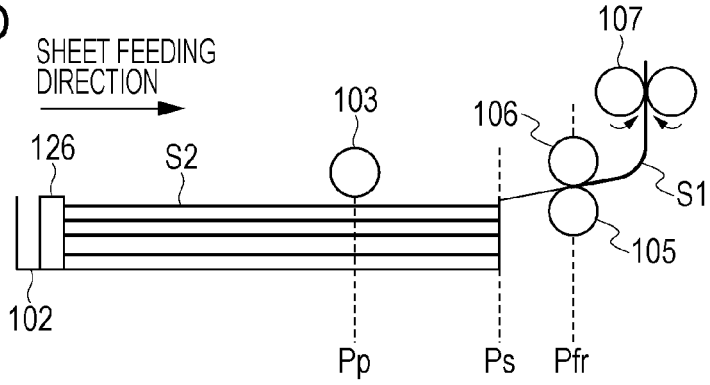

Next, FIG. 3D illustrates a sectional view of the cassette 102 at a time point when the rear end of the sheet S1 reaches the separation nip Pfr constructed by the feed roller 106 and the separation roller 105. The graph in FIG. 4 illustrates a time point T1*d* corresponding to the state illustrated in FIG. 3D. At the time point T1*d* when the rear end of the sheet S1 passes through the position Pfr of the separation nip, the separation roller 105 stops rotating.

Under the first sheet feeding control, as described above, the driving of the pick roller 103 is turned off before the rear end of the sheet S1 passes through the position Pp of the nip of the pick roller 103. Because the leading end of the sheet S2 is not moved from the cassette 102, the sheet S2 can be protected from being wrinkled or folded even when the cassette 102 is drawn from the main body of the printer 101 upon completion of the feeding of the sheet S1. In particular, in a case where the cassette 102 is configured to be drawn in a direction orthogonal to the direction that a sheet S is fed by the pick roller 103, there is a higher possibility that the sheet S2 is wrinkled or folded. However, in the configuration described above, this embodiment can protect the sheet S2 from being wrinkled or folded. There are two possible methods for stopping the driving of the pick roller 103. According to one of the methods, the driving of the pick roller 103 is changed to an OFF at a time point after a predetermined time from a time when the driving of the pick roller 103 is turned on (or from the time point T1*a*). The predetermined time may be changed in accordance with the length in the feeding direction of a sheet S accommodated in the cassette 102. It may be configured that the length in the feeding direction of a sheet S may be automatically detected by the printer 101 from the position of the rear-end regulating plate 126 or that a user may set it externally.

According to the other method, the driving of the pick roller 103 is turned off at a time point when the top sensor 108 on the downstream side of the separation nip constructed by the feed roller 106 and the separation roller 105 detects the leading end of the sheet S. Here, the top sensor 108 is provided at a position where the top sensor 108 can detect the leading end of the sheet S before the rear end of the sheet S does not pass through the pick roller 103.

This embodiment applies one of the two methods for turning off the driving at a time point after a predetermined time. However, any one of the two methods may be applied.

Description of Second Sheet Feeding Control

Next, with reference to FIGS. 5A to 5D and FIG. 6, a second sheet feeding control will be described.

Figure 5A:
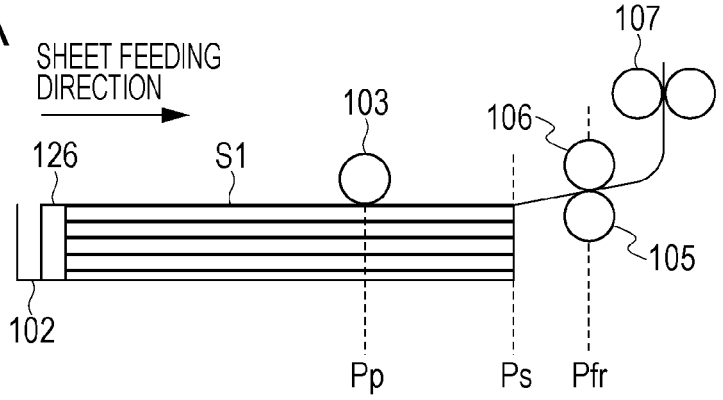
FIGS. 5A to 5D illustrate operations of a second sheet feeding control.
Figure 6:
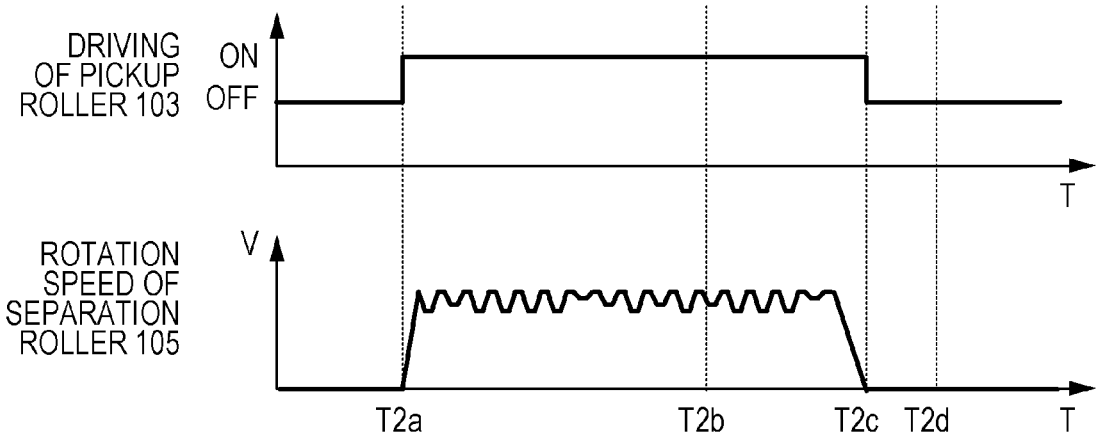
FIG. 6 is a timing chart when the second sheet feeding control is executed.

FIG. 5A is a sectional view of the cassette 102 at a time point when a sheet S1 positioned at the top of the sheets accommodated in the cassette 102 is fed. When the second sheet feeding control is started, the pick roller 103, the feed roller 106, and the separation roller 105 rotate, and the sheet S1 is fed to the right direction (sheet feeding direction) in FIG. 5A. FIG. 6 illustrates a graph having a horizontal axis indicating elapsed times and vertical axes indicating ON/OFF states of the driving of the pick roller 103 and rotation speeds V of the separation roller 105, where a time point T2*a* corresponds to the state illustrated in FIG. 5A. At the time point T2*a*, the driving of the pick roller 103 is shifted from an OFF state to an ON state so that the separation roller 105 starts rotating. Referring to FIG. 5A, Ps, Pp, and Pfr are the same positions as those in FIG. 3A.

Figure 5B:
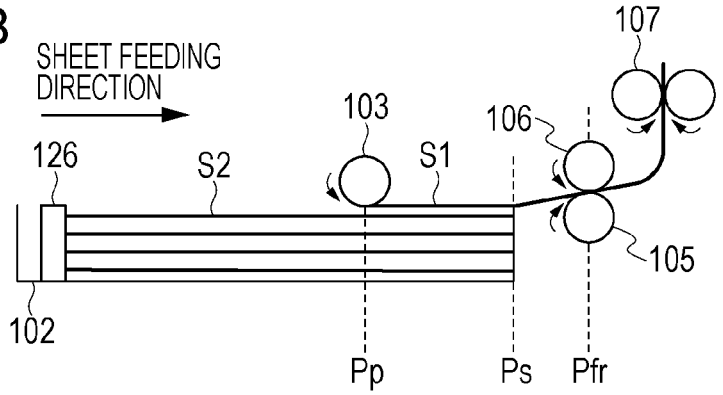

Next, FIG. 5B illustrates a sectional view of the cassette 102 at a time point when the rear end of the sheet S1 (an upstream end in the sheet feeding direction) reaches the position Pp of the nip of the pick roller 103. Under the second sheet feeding control, because a sheet S2 positioned under the sheet S1 is to be fed with the sheet S1 above the sheet S2, the driving of the pick roller 103 is kept in an ON state. When the rear end of the sheet S1 passes through the pick roller 103, the pick roller 103 touches the sheet S2 and feeds the sheet S2 to the right direction. The graph in FIG. 6 illustrates a time point T2*b* corresponding to the state illustrated in FIG. 5B. At the time point T2*b*, the driving of the pick roller 103 keeps its ON state, and the separation roller 105 rotates by following the conveyed sheet S1.

Figure 5C:
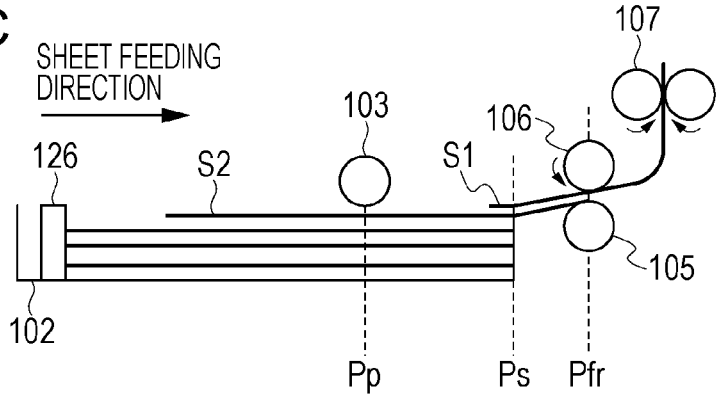

Next, FIG. 5C illustrates a sectional view of the cassette 102 at a time point when the leading end of the sheet S2 reaches the position Pfr of the separation nip constructed by the feed roller 106 and the separation roller 105. The separation roller 105 as described above rotates in a clockwise direction when one sheet S is conveyed to feed the one sheet S. When two sheets S are conveyed, the separation roller 105 stops rotating or rotates in a counterclockwise direction and thus separates one sheet S from the two or more sheets S. In other words, the rotation behavior of the separation roller 105 changes. The graph in FIG. 6 illustrates a time point T2*c* corresponding to the state illustrated in FIG. 5C. Because the leading end of the sheet S2 reaches the position Pfr of the separation nip at the time point T2*c*, the separation roller 105 stops rotating. When the leading end of the sheet S2 reaches the position Pfr of the separation nip, the driving of the pick roller 103 is shifted from an ON state to an OFF to prevent the sheet S2 from being pushed into the separation nip and prevent paper jams.

Figure 5D:
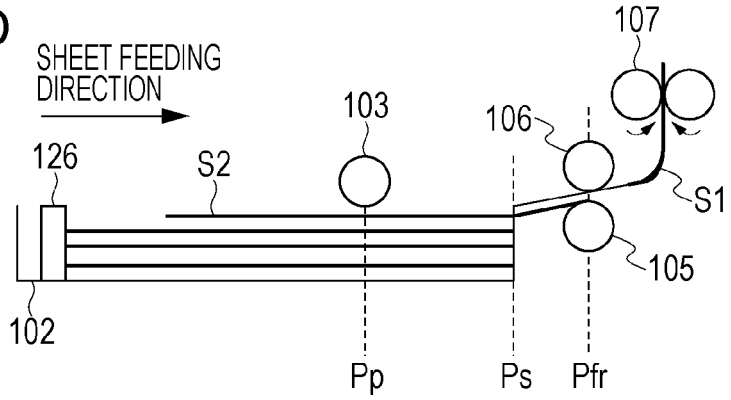

Next, FIG. 5D illustrates a sectional view of the cassette 102 at a time point when the rear end of the sheet S1 passes through the position Pfr of the separation nip constructed by the feed roller 106 and the separation roller 105. The graph in FIG. 6 illustrates a time point T2*d* corresponding to the state illustrated in FIG. 5D.

Under the second sheet feeding control, as described above, if the leading end of the sheet S2 reaches the position Pfr of the separation nip and the separation roller 105 stops rotating or rotates in an opposite direction, the driving of the pick roller 103 is turned off. Because the sheet S1 and the sheet S2 are fed in advance with the sheet S2 placed over the sheet S1, the position of the leading end of the sheet S2 can be matched with the separation nip. This can reduce the distance (also called a sheet interval) between the rear end of the sheet S1 and the leading end of the sheet S2 for continuously performing the sheet feeding operation. In other words, the number of sheets to be printed per unit time period, that is, the productivity of the printer 101 can be increased.

Flowchart for Selecting Sheet Feeding Control

Figure 7:
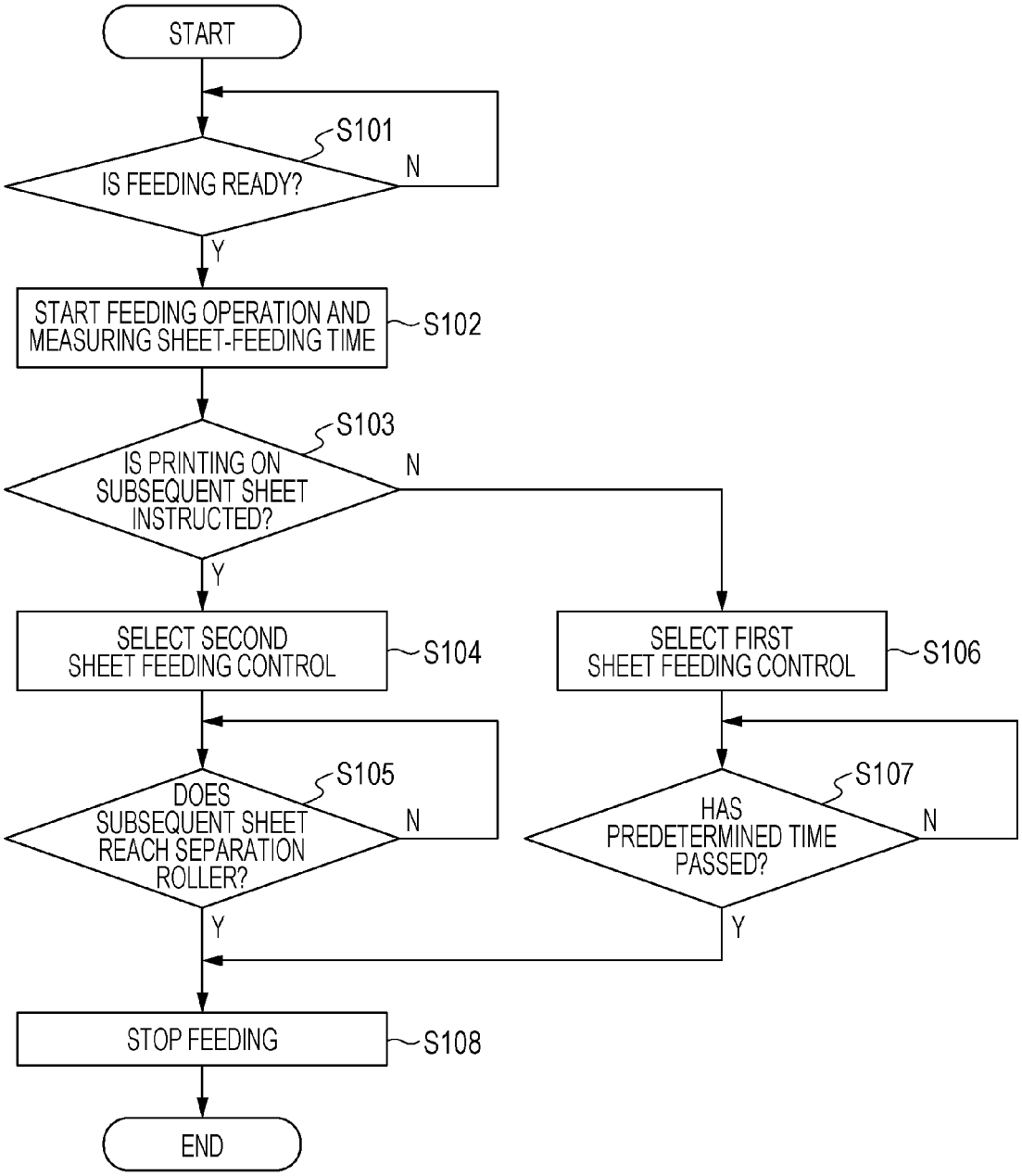
FIG. 7 is a selection flowchart illustrating a sheet feeding control according to a first embodiment.

A method for selecting one of the two sheet feeding controls according to this embodiment will be described with reference to a flowchart in FIG. 7. The control based on the flowchart in FIG. 7 is executed by the engine control unit 201 installed in the control unit 200 based on a program stored in the storage unit 206 such as a ROM.

According to this embodiment, in a case where a print instruction (job) to continuously print a plurality of sheets S is notified to the printer 101, the engine control unit 201 selects one of the two sheet feeding controls in order of feeding of sheets S from the cassette 102.

Before starting the corresponding printing operation, the engine control unit 201 completes preparation for starting printing and judges whether feeding of the sheets S is ready or not (S101). If it is judged that the sheet feeding is ready, the engine control unit 201 next transmits an instruction to start the sheet feeding to the drive control unit 208. The drive control unit 208 receives the instruction to start the sheet feeding and starts an operation for feeding the sheet S1 accommodated at the top in the cassette 102. At the same time, the engine control unit 201 starts counting a sheet feeding time (S102).

The selecting unit 207 checks whether information regarding a print request for the sheet S2 positioned under the sheet S1 in the cassette 102 is stored in the storage unit 206 or not (S103). If the information regarding the print request for the sheet S2 is stored, the selecting unit 207 judges that the currently fed sheet S1 is not a sheet S to be fed lastly in the job and selects the second sheet feeding control (S104). The drive control unit 208 executes the second sheet feeding control in which the driving of the pick roller 103 is turned off at a time point when the leading end of the sheet S2 reaches the position Pfr of the separation nip (S105).

On the other hand, if the information regarding the print request for the sheet S2 is not stored, the selecting unit 207 judges that the currently fed sheet S1 is a sheet S to be fed lastly in the job and selects the first sheet feeding control (S106). The drive control unit 208 then executes the first sheet feeding control in which the driving of the pick roller 103 is turned off at a time point after a predetermined time from the start of the sheet feeding (S107). The engine control unit 201 stops the sheet feeding operation when the first sheet feeding control or the second sheet feeding control ends (S106).

Thus, according to this embodiment, a sheet S that is not to be fed lastly from the cassette 102 is fed under the second sheet feeding control, and a sheet S that is to be fed lastly from the cassette 102 is fed under the first sheet feeding control. After the job ends, there is a possibility that the cassette 102 is drawn by a user, and it is controlled to prevent the sheet S2 from moving from the cassette 102. This can protect the sheet S2 accommodated in the cassette 102 from being damaged. During execution of the job, it is controlled, as in the past, such that the leading end of the sheet S2 is matched with the position Pfr of the separation nip for maintaining the productivity of the printer 101.

According to this embodiment, if an instruction (job) to print on one sheet S is notified to the printer 101, the engine control unit 201 is configured to select the first sheet feeding control. This can protect the sheet S2 accommodated in the cassette 102 from being damaged even when the cassette 102 is drawn by a user after the job ends.

Second Embodiment

A second embodiment will be described in detail. Substantial parts of descriptions thereof are the same as those of the first embodiment, and differences from the first embodiment will only be described.

Figure 8:
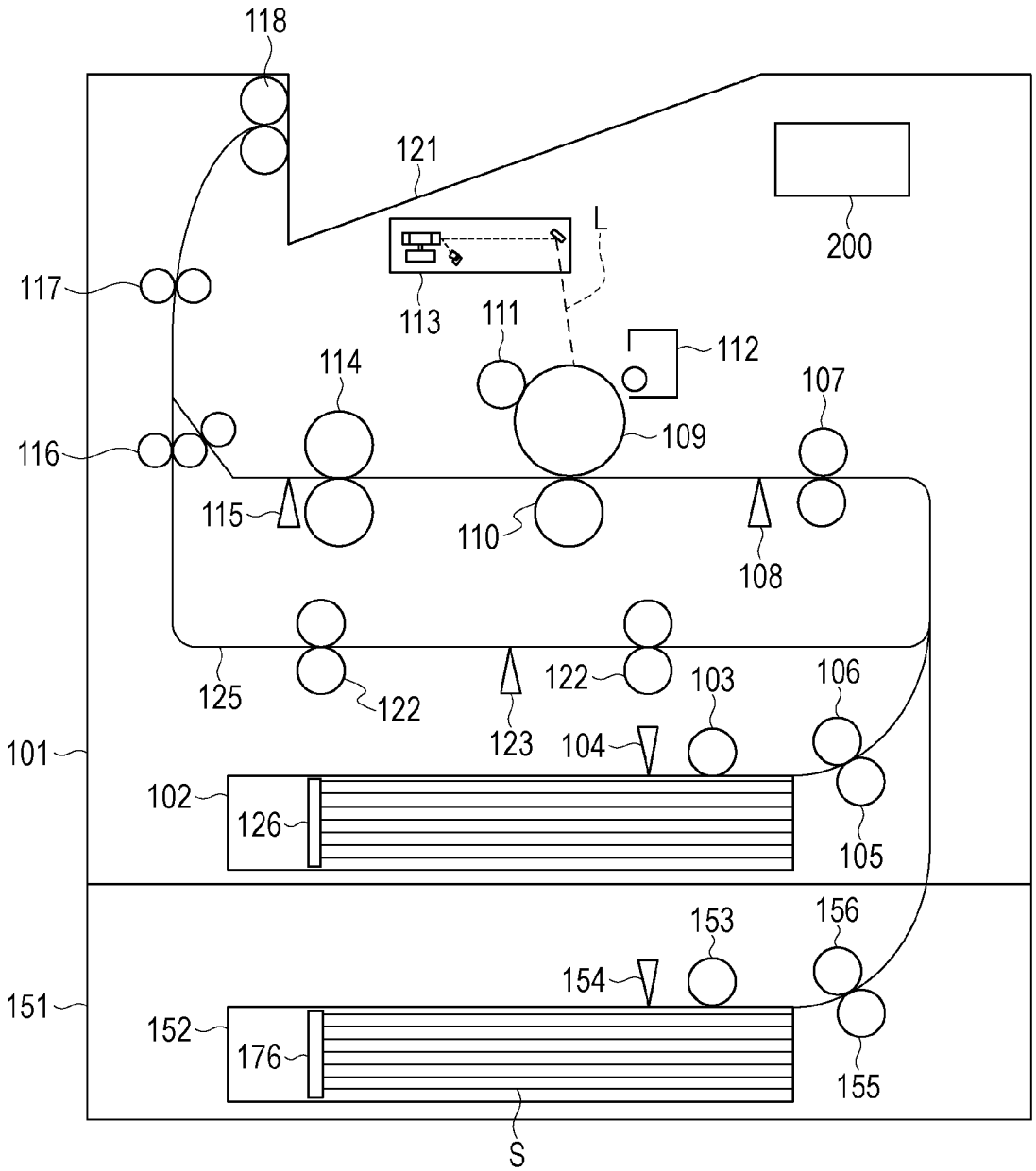
FIG. 8 is a schematic configuration diagram of an image forming apparatus and a sheet feeding option according to a second embodiment.

Description of Configuration of Image Forming Apparatus and Sheet Feeding Option FIG. 8 is a schematic configuration diagram of the printer 101 and a sheet feeding option 151 according to this embodiment. The sheet feeding option 151 is detachably attached to the printer 101 and is configured to feed a sheet S to the printer 101. Because the printer 101 is the same as the one illustrated in FIG. 1, any repetitive description will be omitted.

A cassette 152 is an accommodation unit configured to accommodate sheets S and may be detachably attached to a main body of the sheet feeding option 151. A rear-end regulating plate 176 provided in the cassette 152 is configured to regulate rear ends of the sheets S accommodated in the cassette 152 and set the sheets S at a proper position. With the cassette 152 attached to the main body of the sheet feeding option 151 and the sheet feeding option 151 attached to the printer 101, a pickup roller 153 (hereinafter, called a pick roller 153) feeds a sheet S accommodated in the cassette 152. The sheet S fed by the pick roller 153 is fed to a further downstream side by a feed roller 156 and reaches the top sensor 108 through the registration roller pair 107. A separation roller 155 and the feed roller 156 construct a separation nip which is configured to prevent a plurality of sheets S from being fed to a downstream side of the separation nip. Operations of the separation roller 155 are the same as those of the separation roller 105. Thus, a sheet S positioned at the top in a perpendicular direction of sheets S accommodated in the cassette 152 can only be fed to the registration roller pair 107.

The engine control unit 201 included in the control unit 200 is configured to control the pick roller 153, the feed roller 156, and the separation roller 155 in the sheet feeding option 151. An encoder (not illustrated) configured to detect a rotation state of the separation roller 155 is further connected to the engine control unit 201.

Flowchart for Selecting Sheet Feeding Control

Figure 9:
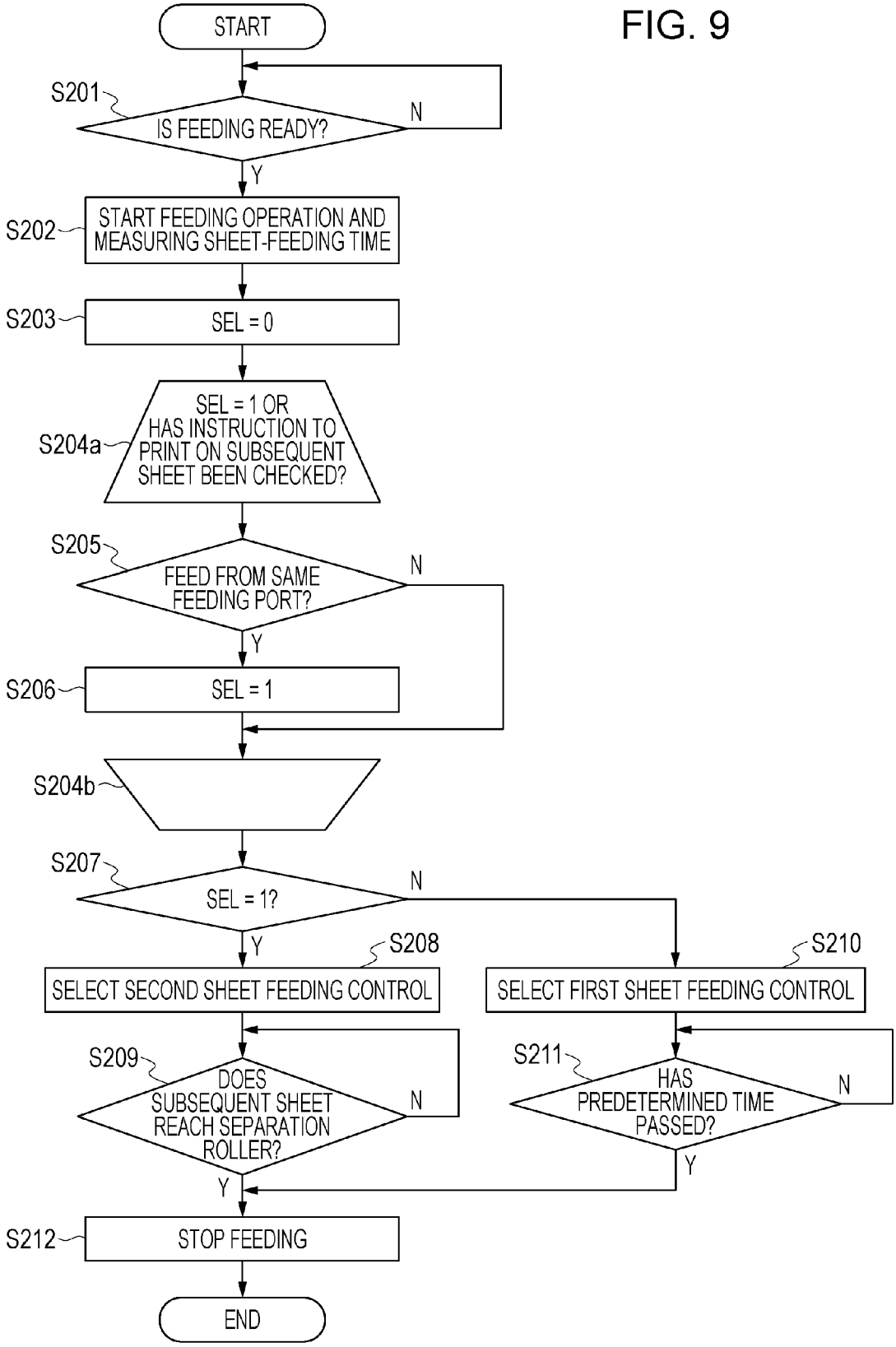
FIG. 9 is a selection flowchart illustrating a sheet feeding control according to the second embodiment.

A method for selecting one of the two sheet feeding controls according to this embodiment will be described with reference to the flowchart in FIG. 9. The control based on the flowchart in FIG. 9 is executed by the engine control unit 201 installed in the control unit 200 based on a program stored in the storage unit 206 such as a ROM.

According to this embodiment, in a case where a print instruction (job) to continuously print a plurality of sheets S is notified to the printer 101, the engine control unit 201 selects one of the two sheet feeding controls in order of feeding of sheets S and based on a sheet feeding port (cassette 102 or cassette 152).

Before starting the corresponding printing operation, the engine control unit 201 completes preparation for starting printing and judges whether feeding of the sheets S is ready or not (S201). If it is judged that the sheet feeding is ready, the engine control unit 201 next transmits an instruction to start the sheet feeding to the drive control unit 208. The drive control unit 208 receives the instruction to start the sheet feeding and starts an operation for feeding the sheet S1 accommodated at the top in the accommodation unit (cassette 102 or cassette 152) from which sheets are to be fed. At the same time, the engine control unit 201 starts counting a sheet feeding time (S202).

Next, the selecting unit 207 initializes a variable SEL to 0 (S203). The variable SEL is to be used for selecting a sheet feeding control. If the variable SEL is 0, the selecting unit 207 selects the first sheet feeding control. If the variable SEL is 1, the selecting unit 207 selects the second sheet feeding control. The selecting unit 207 checks information regarding print requests stored in the storage unit 206 or performs the following repeated processing until it is determined that the variable SEL is equal to 1 (S204*a*, S204*b*). As the repeated processing, the selecting unit 207 determines from the information regarding the print requests whether there is a sheet S2 which is to be fed from the same sheet feeding port as the sheet feeding port (the cassette 102 or the cassette 152) to which the sheet S1 is currently fed or not (S205). If there is a sheet S2 to be fed from the same sheet feeding port, the selecting unit 207 updates the variable SEL to 1 (S206). On the other hand, if there is not a sheet S2 to be fed from the same sheet feeding port, the selecting unit 207 does not update the variable SEL.

After the repeated processing ends, the selecting unit 207 selects a sheet feeding control to be executed based on the value of the variable SEL (S207). If the variable SEL is 1, that is, if there is a sheet S2 to be fed from the same sheet feeding port, the selecting unit 207 selects the second sheet feeding control (S208). The drive control unit 208 then executes the second sheet feeding control in which the driving of the pick roller 103 is turned off at a time point when the leading end of the sheet S2 reaches the position Pfr of the separation nip (S209).

On the other hand, if the variable SEL is 0, that is, if there is not a sheet S2 to be fed from the same sheet feeding port (or if the currently fed sheet S1 is the last sheet to be fed from the sheet feeding port), the selecting unit 207 selects the first sheet feeding control (S210). The drive control unit 208 then executes the first sheet feeding control in which the driving of the pick roller 103 is turned off at a time point after a predetermined time from the start of the sheet feeding (S211). The engine control unit 201 stops the sheet feeding operation when the first sheet feeding control or the second sheet feeding control ends (S212).

Thus, according to this embodiment, a sheet S that is not fed lastly of sheets S to be fed from the cassette 102 and a sheet S that is not fed lastly of sheets S to be fed from the cassette 152 are fed under the second sheet feeding control. A sheet S that is fed lastly of the sheets S to be fed from the cassette 102 and a sheet S that is fed lastly of the sheets S to be fed from the cassette 152 are fed under the first sheet feeding control. After the job ends, there is a possibility that the cassette 102 or the cassette 152 is drawn by a user, and it is controlled to prevent the sheet S2 from moving from the corresponding sheet feeding port. This can protect the sheet S2 accommodated in the cassette 102 or the cassette 152 from being damaged. During execution of the job, it is controlled, as in the past, such that the leading end of the sheet S2 is matched with the position Pfr of the separation nip for keeping the productivity of the printer 101.

Having described a case that, according to this embodiment, sheets are fed from the cassette 102 provided in the printer 101 and the cassette 152 provided in the sheet feeding option 151, embodiments are not limited thereto. A plurality of sheet feeding ports may be provided in the printer 101.

Having described that, according to the first and second embodiments, a sheet feeding control is selected based on whether there is information regarding a print request for the sheet S2 or not, a sheet feeding control may be selected from information regarding a print request for the sheet S1 that is currently being fed. For example, a sheet feeding control may be selected from information describing whether the last printing operation is to be performed or not, which is added to the information regarding the print request.

Third Embodiment

A third embodiment will be described in detail. Substantial parts of descriptions thereof are the same as those of the first embodiment, and differences from the first embodiment will only be described.

Flowchart for Selecting Sheet Feeding Control

A method for selecting one of the two sheet feeding controls according to this embodiment will be described with reference to the flowchart in FIG. 10. The control based on the flowchart in FIG. 10 is executed by the engine control unit 201 installed in the control unit 200 based on a program stored in the storage unit 206 such as a ROM.

According to this embodiment, in a case where a print instruction (job) to continuously print a plurality of sheets S is notified to the printer 101, the engine control unit 201 selects one of the two sheet feeding controls based on a speed for printing on a sheet S, that is, a sheet feeding speed (or feeding speed) for a sheet S.

Figure 10:
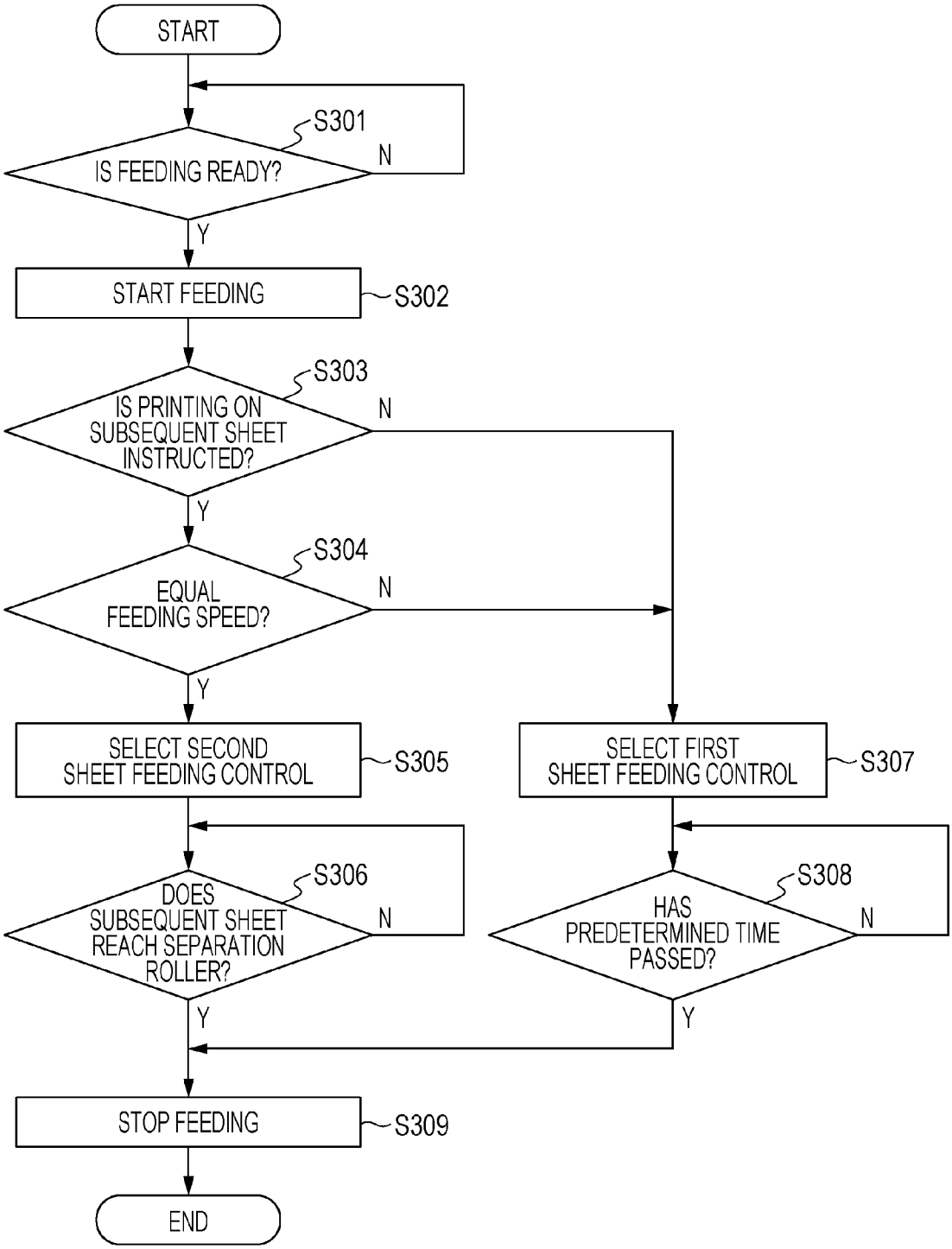
FIG. 10 is a selection flowchart illustrating a sheet feeding control according to a third embodiment.

Because the control operations in S301 to S303 illustrated in FIG. 10 are the same as those in S101 to S103 illustrated in FIG. 7, any repetitive description will be omitted. In S303, if information regarding a print request for the sheet S2 is stored, the selecting unit 207 checks the sheet feeding speed for the sheet S2 and compares it with the sheet feeding speed for the sheet S1 (S304). If the sheet feeding speed for the sheet S1 is equal to the sheet feeding speed for the sheet S2, the selecting unit 207 selects the second sheet feeding control (S305). The drive control unit 208 then executes the second sheet feeding control in which the driving of the pick roller 103 is turned off at a time point when the leading end of the sheet S2 reaches the position Pfr of the separation nip (S306).

On the other hand, if information regarding a print request for the sheet S2 is not stored or if the sheet feeding speed for the sheet S1 is different from the sheet feeding speed for the sheet S2, the selecting unit 207 selects the first sheet feeding control (S307). The drive control unit 208 then executes the first sheet feeding control in which the driving of the pick roller 103 is turned off at a time point after a predetermined time from the start of the sheet feeding (S308). The engine control unit 201 stops the sheet feeding operation when the first sheet feeding control or the second sheet feeding control ends (S309).

A reason will be described why the first sheet feeding control is selected in a case where the sheet feeding speed for the sheet S1 is different from the sheet feeding speed for the sheet S2. The second sheet feeding control is executed to minimize the sheet interval between the sheet S1 and the sheet S2. On the other hand, if the sheet feeding speed for the sheet S1 is different from the sheet feeding speed for the sheet S2, preparation processing including changing the speed of a motor in accordance with a changed sheet feeding speed. This increases the sheet interval between the sheet S1 and the sheet S2. For that, the second control for minimizing the sheet interval is not necessary. In such a case not requiring the second control in particular, the sheet S2 may be controlled so as not to move from the cassette 102. Thus, the sheet S2 accommodated in the cassette 102 can be protected from being damaged.

Thus, according to this embodiment, in a case where the sheet feeding speed for a sheet S1 fed previously is equal to the sheet feeding speed for a sheet S2 to be fed subsequently to the sheet, the sheet S1 is fed under the first sheet feeding control. On the other hand, if the sheet feeding speed for the sheet S1 is different from the sheet feeding speed for the sheet S2, the sheet S2 is fed under the second sheet feeding control. Thus, the sheet S2 accommodated in the cassette 102 can be protected from being damaged without influencing on the productivity of the printer 101.

Having described that, according to this embodiment, a sheet feeding control for the sheet S1 is selected based on a result of determination on whether the sheet feeding speed for the sheet S1 is equal to the sheet feeding speed for the sheet S2 or not, embodiments are not limited thereto. The sheet feeding control for the sheet S1 may be selected based on whether an image forming condition for forming an image on the sheet S1 is the same as an image forming condition for forming an image on the sheet S2 by the image forming unit. The image forming conditions may include the amount of light in the laser scanner 113 and fixing temperatures of the fixing device 114. If these image forming conditions are different, a preparation operation is required in a sheet interval. Whether the image forming conditions are the same or not may be judged based on paper type information (such as plain paper, thick paper, and thin paper) of a sheet S accommodated in the cassette 102 or designated print mode information (such as gloss mode, power-saving mode).

While the sheet feeding control for the sheet S1 is selected immediately after the start of a sheet feeding operation on the sheet S1 according to the first to third embodiments, the selection may be executed at a time point when the pick roller 103 is turned off under the first sheet feeding control (or a time point after a predetermined time from the start of the sheet feeding).

Fourth Embodiment

A fourth embodiment will be described in detail. Substantial parts of descriptions thereof are the same as those of the first embodiment, and differences from the first embodiment will only be described.

According to this embodiment, the driving of the pick roller 103 is stopped under the first sheet feeding control at a time point when the top sensor 108 detects a leading end of a sheet S. Detection of the leading end of a sheet S by the top sensor 108 is further added as a condition for stopping the driving of the pick roller 103 under the second sheet feeding control. In other words, under the second sheet feeding control according to this embodiment, the driving of the pick roller 103 is turned on if a leading end of a sheet S1 is detected by the top sensor 108 and if the leading end of a subsequent sheet S2 reaches the position Pfr of the separation nip.

Flowchart for Selecting Sheet Feeding Control

Figure 11:
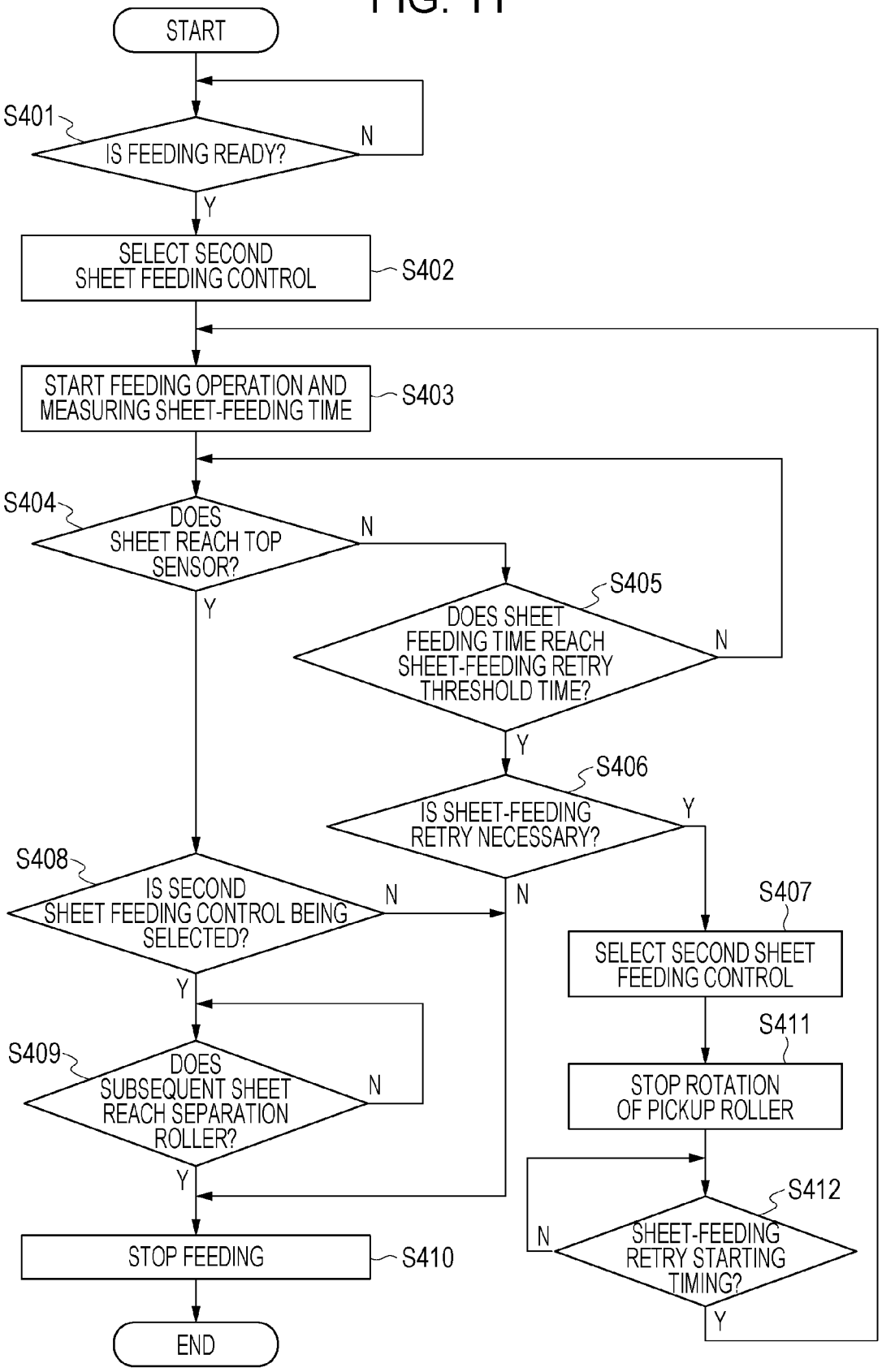
FIG. 11 is a selection flowchart illustrating a sheet feeding control according to a fourth embodiment.

A method for selecting one of the two sheet feeding controls according to this embodiment will be described with reference to the flowchart in FIG. 11. The control based on the flowchart in FIG. 11 is executed by the engine control unit 201 installed in the control unit 200 based on a program stored in the storage unit 206 such as a ROM.

According to this embodiment, if the top sensor 108 does not detect a leading end of a sheet S in a threshold time period after start of the second sheet feeding control, a sheet feeding retry is performed (to feed the sheet again). Here, the sheet feeding retry includes stopping rotation of the pick roller 103 once and rotating it again. Stopping rotation of the pick roller 103 once may facilitate to pick a sheet S by the pick roller 103. The engine control unit 201 selects the first sheet feeding control to execute a sheet feeding retry.

First, before starting the printing operation, the engine control unit 201 completes preparation for starting printing and judges whether it is ready for feeding a sheet S or not (S401). If it is judged that it is ready, the selecting unit 207 selects the second sheet feeding control (S402) and transmits an instruction to start the feeding to the drive control unit 208. The drive control unit 208 receives the instruction to start the feeding and starts an operation for feeding the top sheet S1 of sheets accommodated in the cassette 102. Simultaneously with it, the engine control unit 201 further starts counting a sheet feeding time (S403).

Next, the engine control unit 201 checks whether the top sensor 108 detects a sheet S or not (S404). If not, the engine control unit 201 checks whether the sheet feeding time that is being counted reaches a sheet-feeding retry threshold time or not (S405). The sheet-feeding retry threshold time may be a maximum delay time calculated in advance based on the length of a convey path, an operation characteristic of an actuator or the like. If the sheet feeding time that is being counted reaches the sheet-feeding retry threshold time, the engine control unit 201 judges that there is a high possibility that a conveyance failure (also called a paper jam) occurs and judges whether a sheet feeding retry is necessary or not (S406). The necessity of a sheet feeding retry may be judged based on a predetermined number (at least one) of sheet feeding retries, for example. If the number of sheet feeding retries having been executed up to this point is lower than the predetermined number of sheet feeding retries, the engine control unit 201 judges that a sheet feeding retry is necessary. If it is judged that a sheet feeding retry is necessary, the selecting unit 207 selects the first sheet feeding control (S407) and transmits an instruction to start a sheet feeding retry to the drive control unit 208. In response to the instruction to start a sheet feeding retry, the drive control unit 208 stops the rotation of the pick roller 103 once (S411). At a starting time for a sheet feeding retry (S412), the drive control unit 208 resumes the sheet feeding operation including starting the rotation of the point pick roller 103 (S403). Thus, the sheet feeding retry is executed.

On the other hand, if it is judged in S404 that the top sensor 108 detects a sheet S, the engine control unit 201 checks whether the second sheet feeding control is currently selected or not (S408). If the second sheet feeding control is being selected, the drive control unit 208 executes the second sheet feeding control in which the driving of the pick roller 103 is turned off at a time point when the leading end of the sheet S2 reaches the position Pfr of the separation nip (S409). If the second sheet feeding control ends, the engine control unit 201 stops the sheet feeding operation (S410). If the first sheet feeding control is being selected, the engine control unit 201 stops the sheet feeding operation because the top sensor 108 has already detected a sheet S (S410). If it is judged in S406 that no sheet feeding retry is necessary, the engine control unit 201 stops the sheet feeding operation (S410).

According to this embodiment, as described above, in a case where the second sheet feeding control is selected and where the top sensor 108 does not detect a sheet S until the sheet-feeding retry threshold time passes from start of feeding of the sheet S by the pick roller 103, the first sheet feeding control is selected, and a sheet feeding retry is executed. When a sheet feeding retry is to be executed, in other words, if it is difficult for the pick roller 103 to feed a sheet S smoothly, it may be determined that there is a high possibility that a sheet-feeding delay paper jam will occur in future and the cassette 102 will be drawn. Then, the sheet S2 is controlled not to move from the cassette 102. This can protect the sheet S2 accommodated in the cassette 102 from being damaged. In a case where a sheet feeding retry is not to be executed, the control for causing the leading end of the sheet S2 to be matched with the position Pfr of the separation nip is executed as in the past. Thus, the productivity of the printer 101 can be maintained.

Fifth Embodiment

A fifth embodiment will be described in detail. Substantial parts of descriptions thereof are the same as those of the first embodiment, and differences from the first embodiment will only be described.

According to this embodiment, the driving of the pick roller 103 is stopped under the first sheet feeding control at a time point when the top sensor 108 detects a leading end of a sheet S. Detection of the leading end of a sheet S by the top sensor 108 is further added as a condition for stopping the driving of the pick roller 103 under the second sheet feeding control. In other words, under the second sheet feeding control according to this embodiment, the driving of the pick roller 103 is turned on if a leading end of a sheet S1 is detected by the top sensor 108 and if the leading end of a subsequent sheet S2 reaches the position Pfr of the separation nip.

Flowchart for Selecting Sheet Feeding Control

A method for selecting one of the two sheet feeding controls according to this embodiment will be described with reference to the flowchart in FIG. 12. The control based on the flowchart in FIG. 12 is executed by the engine control unit 201 installed in the control unit 200 based on a program stored in the storage unit 206 such as a ROM.

According to this embodiment, if the top sensor 108 does not detect a leading end of a sheet S in a threshold time period passed from start of the second sheet feeding control, the control is switched to the first sheet feeding control and the sheet feeding operation is continued without stopping the rotation of the pick roller 103.

Figure 12:
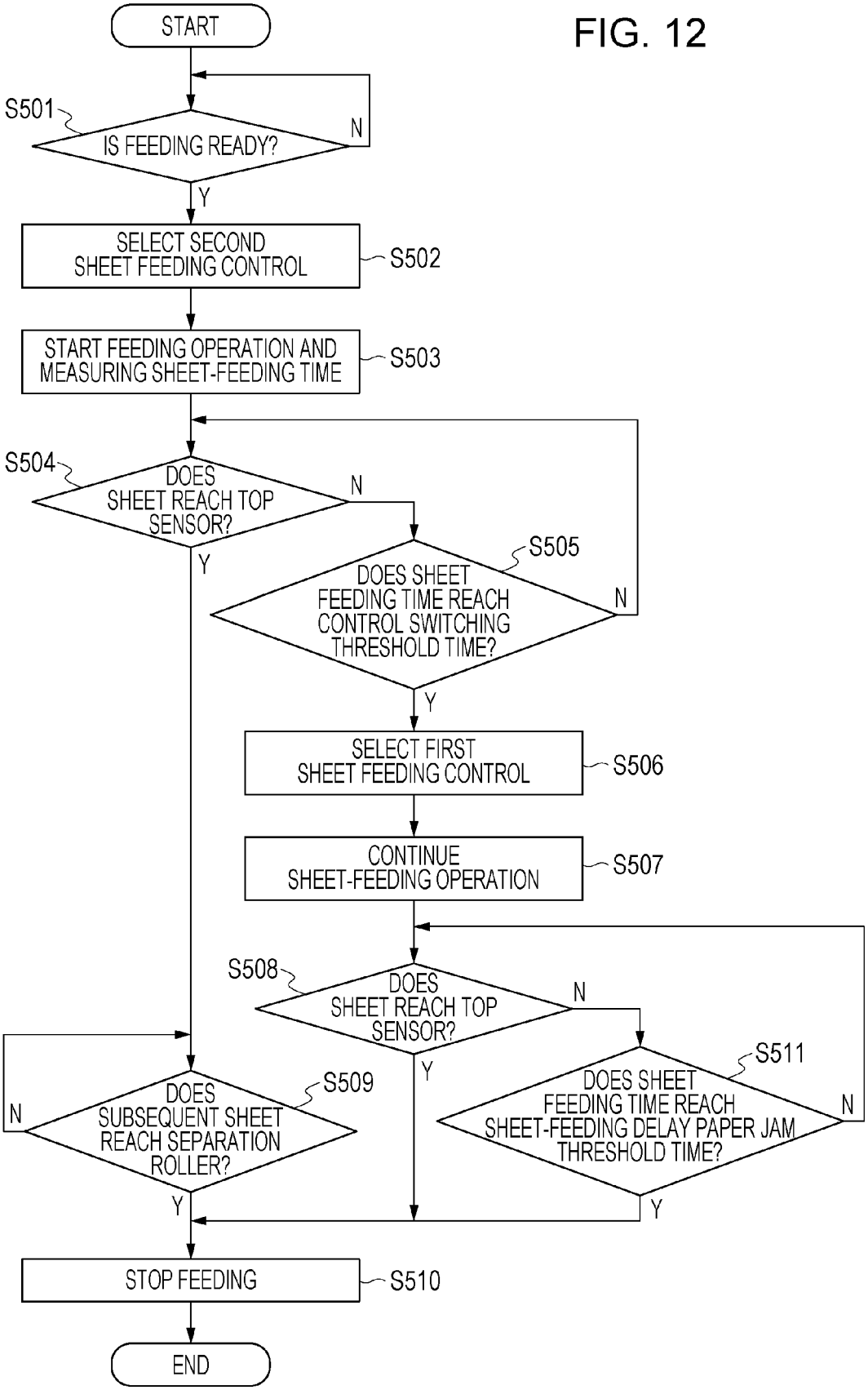
FIG. 12 is a selection flowchart illustrating a sheet feeding control according to a fifth embodiment.

Because the control performed in S501 to S504 in FIG. 12 is the same as that performed in S401 to S404 in FIG. 11, any repetitive description will be omitted. In S504, if the top sensor 108 does not detect a sheet S, the engine control unit 201 checks whether the sheet feeding time that is being counted reaches a control switching threshold time or not (S505). The control switching threshold time may be an average value of past detection results, for example. In other words, it may be an average value of past time periods from start of a sheet feeding operation to detection of a sheet S by the top sensor 108.

If the sheet feeding time that is being counted reaches a control switching threshold time, the engine control unit 201 judges that there is a high possibility that a conveyance failure (also called a paper jam) occurs, and the selecting unit 207 selects the first sheet feeding control (S506). Then, the drive control unit 208 continues the sheet feeding operation without stopping the rotation of the pick roller 103 (S507). The engine control unit 201 continues the detection of a sheet S by the top sensor 108 (S508). If a sheet S is detected in S508, the engine control unit 201 stops the sheet feeding operation (S510). If a sheet S is not detected in S508, whether the sheet feeding time that is being counted reaches a predetermined sheet-feeding delay paper jam threshold time or not (S511). If the sheet feeding time that is being counted reaches the sheet-feeding delay paper jam threshold time, the engine control unit 201 judges that a paper jam has occurred and stops the sheet feeding operation (S510). The sheet-feeding delay paper jam threshold time may be set as a threshold time longer than the control switching threshold time.

On the other hand, if the top sensor 108 detects a sheet S in S504, the drive control unit 208 executes the second sheet feeding control in which the driving of the pick roller 103 is turned off at a time point when the leading end of the sheet S2 reaches the position Pfr of the separation nip (S509). If the second sheet feeding control ends, the engine control unit 201 stops the sheet feeding operation (S510).

According to this embodiment, in a case where the second sheet feeding control is selected and where the top sensor 108 does not detect a sheet S until the control switching threshold time passes from start of sheet feeding of a sheet S by the pick roller 103, the control is switched to the first sheet feeding control and the sheet feeding operation continues. According to this embodiment, in addition to the effect acquired by the fourth embodiment, the following effect can be provided. That is, because the sheet feeding operation is continued without stopping the rotation of the pick roller 103 once, the time for changing the speed of the motor is not necessary so that sheets S can be fed more quickly than the fourth embodiment.

Sixth Embodiment

A sixth embodiment will be described in detail. Substantial parts of descriptions thereof are the same as those of the first embodiment, and differences from the first embodiment will only be described.

According to this embodiment, the driving of the pick roller 103 is stopped under the first sheet feeding control at a time point when the top sensor 108 detects a leading end of a sheet S. Detection of the leading end of a sheet S by the top sensor 108 is further added as a condition for stopping the driving of the pick roller 103 under the second sheet feeding control. In other words, under the second sheet feeding control according to this embodiment, the driving of the pick roller 103 is turned on if a leading end of a sheet S1 is detected by the top sensor 108 and if the leading end of a subsequent sheet S2 reaches the position Pfr of the separation nip.

Flowchart for Selecting Sheet Feeding Control

Figure 13:
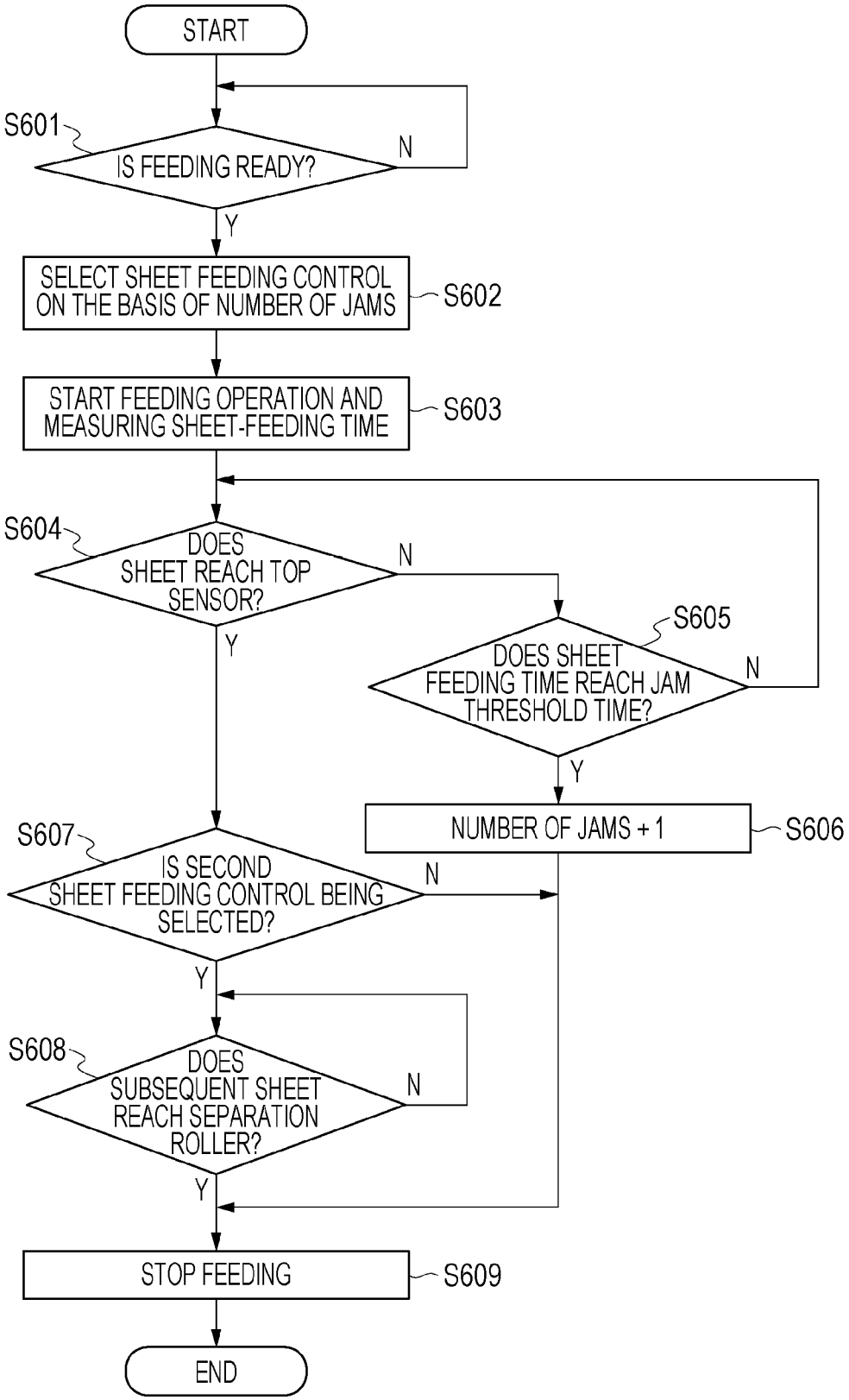
FIG. 13 is a selection flowchart illustrating a sheet feeding control according to a sixth embodiment.

A method for selecting one of the two sheet feeding controls according to this embodiment will be described with reference to the flowchart in FIG. 13. The control based on the flowchart in FIG. 13 is executed by the engine control unit 201 installed in the control unit 200 based on a program stored in the storage unit 206 such as a ROM. According to this embodiment, the engine control unit 201 selects one of the two sheet feeding controls based on the number of past paper jams.

First, before starting the printing operation, the engine control unit 201 completes preparation for starting printing and judges whether it is ready for feeding a sheet S or not (S601). If it is judged that it is ready, the selecting unit 207 selects one of the two sheet feeding controls based on the number of past paper jams stored in the storage unit 206 (S602). If the number of past paper jams is equal to or higher than a lifetime threshold number of times, the selecting unit 207 judges that there is a high possibility that a conveyance failure (also called a paper jam) will occur in future and selects the first sheet feeding control. On the other hand, if the number of past paper jams is lower than the lifetime threshold number of times, the selecting unit 207 selects the second sheet feeding control for expanded productivity. Here, the lifetime threshold number of times may be calculated empirically in advance and may be a value equal to or higher than at least one. The lifetime threshold number of times is not required to be a fixed value but may vary in accordance with the total number of sheets S fed by the pick roller 103. The selecting unit 207 transmits an instruction to start sheet feeding to the drive control unit 208. The drive control unit 208 receives the instruction to start the feeding and starts an operation for feeding the top sheet S1 of sheets accommodated in the cassette 102. Simultaneously with it, the engine control unit 201 further starts counting a sheet feeding time (S603).

Next, the engine control unit 201 checks whether the top sensor 108 detects a sheet S or not (S604). If not, the engine control unit 201 checks whether the sheet feeding time that is being counted reaches the paper jam threshold time or not (S605). If the sheet feeding time that is being counted reaches the paper jam threshold time, the engine control unit 201 judges that a paper jam has occurred and counts up the number of paper jams (S606). The updated number of paper jams is stored in the storage unit 206. The engine control unit 201 further stops the sheet feeding operation (S609). In this case, an error message may be displayed on a display unit, not illustrated, to notify a user of occurrence of the paper jam.

On the other hand, if the top sensor 108 detects a sheet S in S604, the engine control unit 201 checks whether the second sheet feeding control is currently selected or not (S607). If the second sheet feeding control is being selected, the drive control unit 208 executes the second sheet feeding control in which the driving of the pick roller 103 is turned off at a time point when the leading end of the sheet S2 reaches the position Pfr of the separation nip (S608). If the second sheet feeding control ends, the engine control unit 201 stops the sheet feeding operation (S609). If the first sheet feeding control is being selected, the engine control unit 201 stops the sheet feeding operation because the top sensor 108 has already detected a sheet S (S609).

According to this embodiment, as described above, if the number of past paper jams is equal to or higher than a lifetime threshold number of times, the sheet S1 is fed under the first sheet feeding control. On the other hand, if the number of past paper jams is lower than the lifetime threshold number of times, the sheet S1 is fed under the second sheet feeding control. In a case where many paper jams have occurred in the past, it may be determined that there is a high possibility that a paper jam will occur in future and thus controls to prevent the sheet S2 from moving from the cassette 102. This can protect the sheet S2 accommodated in the cassette 102 from being damaged without influencing on the productivity of the printer 101.

Having described that, according to this embodiment, a sheet feeding control is selected based on the number of past paper jams, a sheet feeding control may be selected based on the number of past print errors, for example, because it may only be required that it can be detected from the information that the remaining lifetime of a processing member (consumable part) is short.

Alternatively, the configuration according to the second embodiment may be applied so that the number of past paper jams is managed and is controlled for each sheet feeding port. Thus, the number of selections of the first sheet feeding control can be reduced for a sheet feeding port having a remaining lifetime that is not short so that the reduction of the productivity can be prevented.

The methods for setting threshold values (including a sheet-feeding retry threshold time, a control switching threshold time, and a paper jam threshold time) according to the fourth to sixth embodiments are given for illustration purpose only, and embodiments are not limited thereto. Those threshold values may be set based on past detection results, that is, an average value, a variance value, or a standard deviation in the past of elapsed times from start of a sheet feeding operation to detection of a sheet S by the top sensor 108.

Variation Examples

Figure 14:
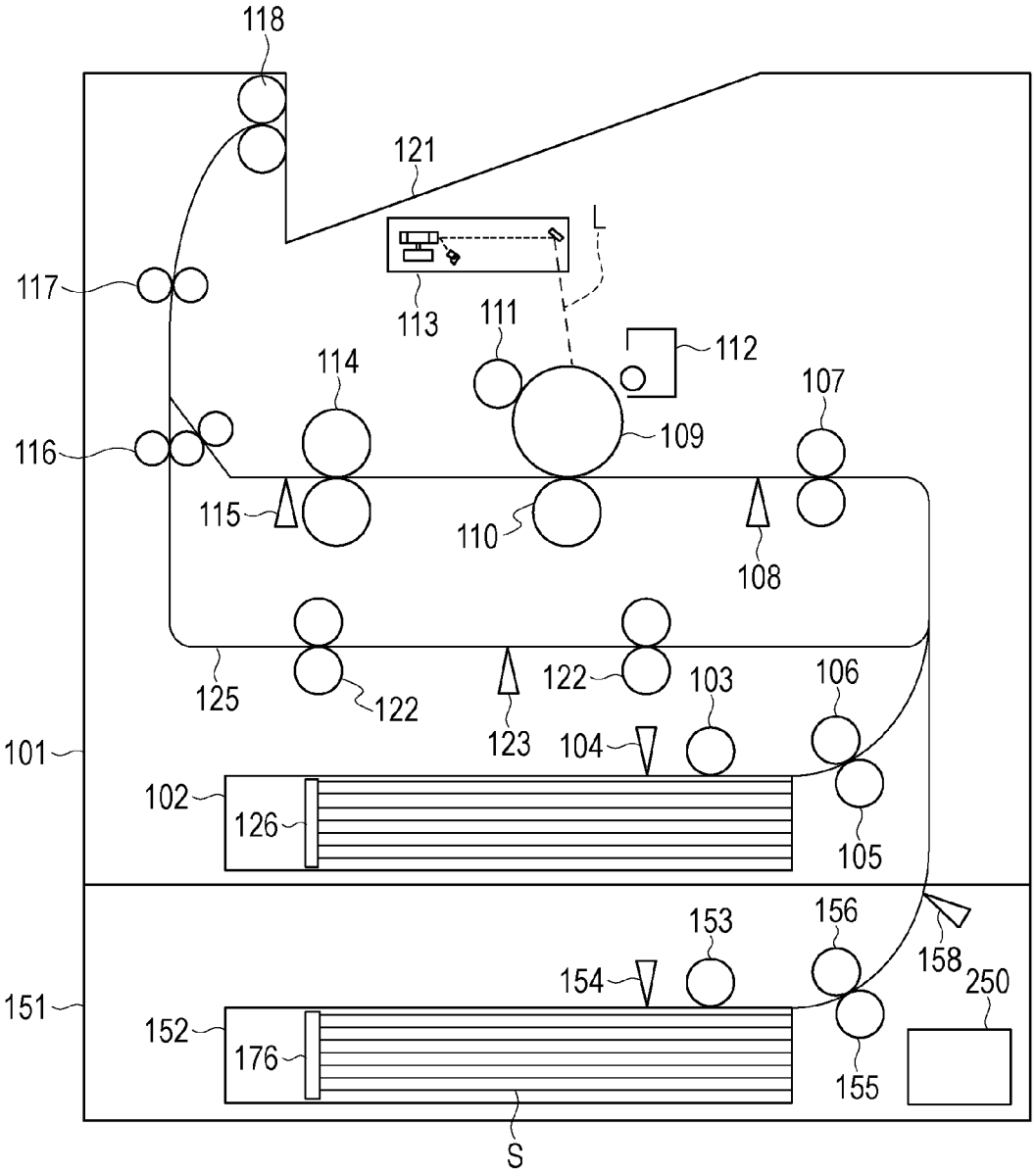
FIG. 14 is a schematic configuration diagram illustrating an image forming apparatus and a sheet feeding option according to a variation example.

According to the first to sixth embodiments, the control unit 200 is installed in the printer 101, for example. However, embodiments are not limited thereto. As illustrated in FIG. 14, an option control unit 250 may be installed in the sheet feeding option 151 detachably attached to the printer 101. The option control unit 250 may execute the aforementioned controls.

The cassette 152 is an accommodation unit configured to accommodate a sheet S (recording material) and is detachably attached to a main body of the sheet feeding option 151. The rear-end regulating plate 176 provided in the cassette 152 is configured to regulate a rear end (or an end on an upstream side in the feeding direction) of a sheet S accommodated in the cassette 152 and set the sheet S at a proper position. With the cassette 152 attached to the main body of the sheet feeding option 151, a pickup roller 153 (hereinafter, called a pick roller 153) feeds a sheet S accommodated in the cassette 152. The sheet S fed by the pick roller 153 is fed to the further downstream side by a feed roller 156 and reaches the top sensor 108 through an option sensor 158 and the registration roller pair 107. A separation roller 155 and the feed roller 156 construct a separation nip which is configured to prevent a plurality of sheets S from being fed to a downstream side of the separation nip. The separation roller 155 operates in the same manner as that of the separation roller 105. Thus, a sheet S positioned at the top in a perpendicular direction of sheets S accommodated in the cassette 152 can only be fed to the registration roller pair 107.

Figure 15:
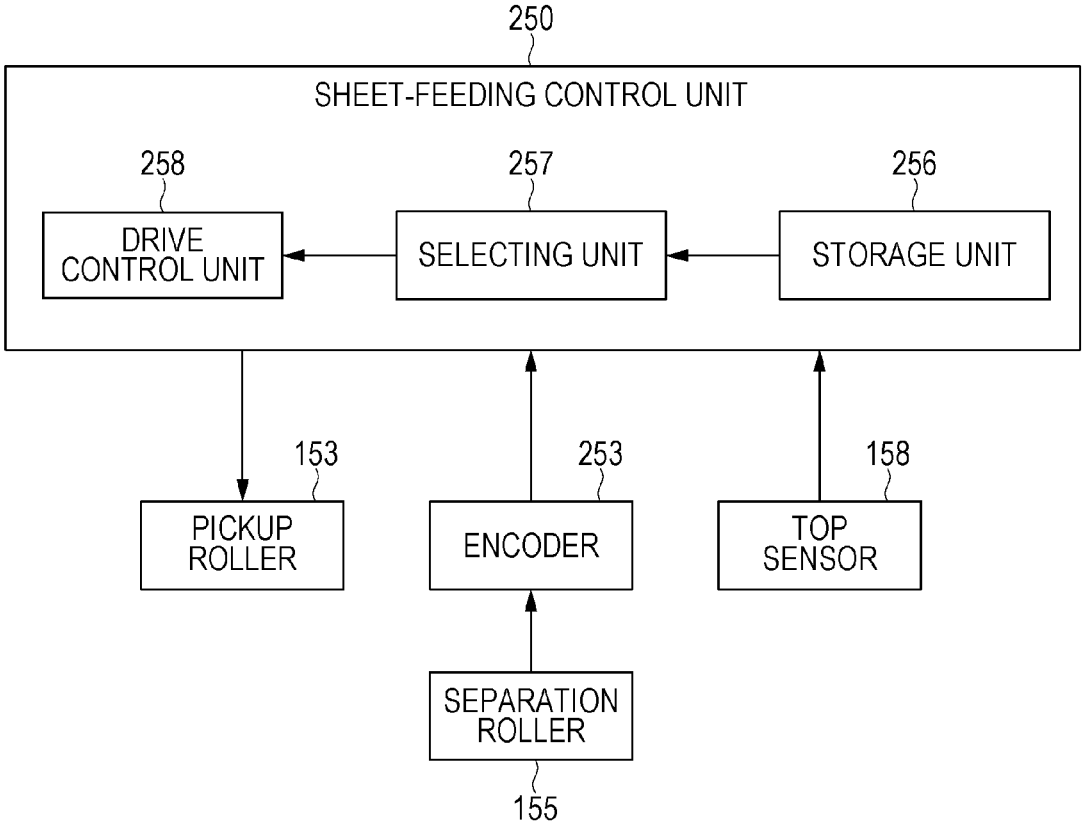
FIG. 15 is a control block diagram illustrating a sheet feeding option according to the variation example.
Figure 16A:
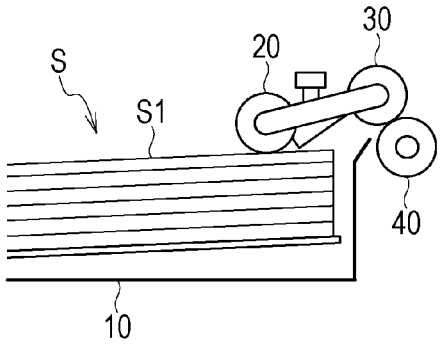
FIGS. 16A to 16E illustrate operations of a sheet feeding control according to a technology in the past.
Figure 16B:
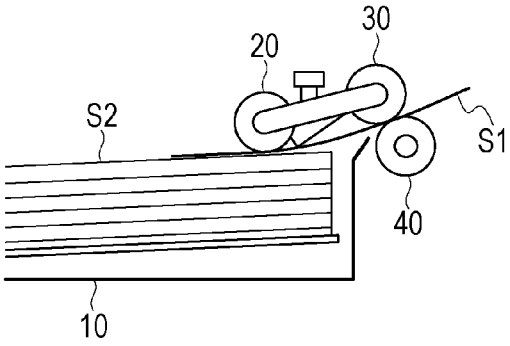
Figure 16C:
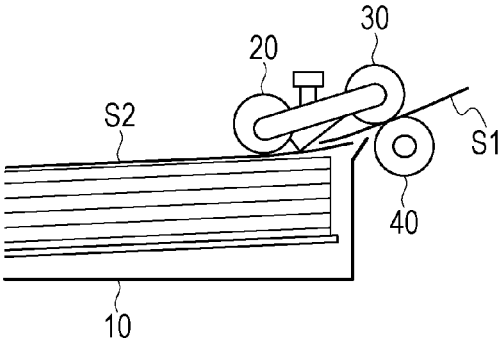
Figure 16D:
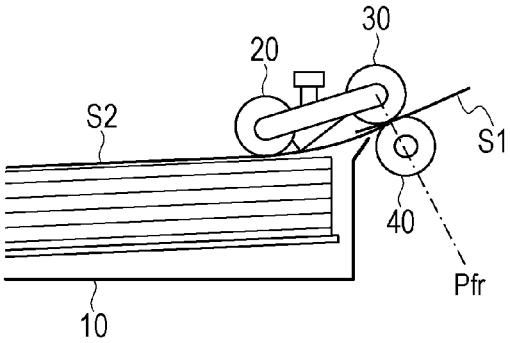
Figure 16E:
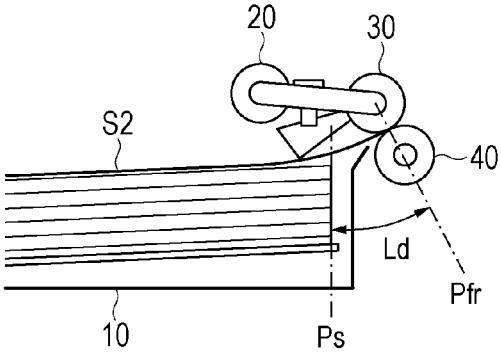

FIG. 15 is a control block diagram of the option control unit 250. The option control unit 250 has a storage unit 256, a selecting unit 257, and a drive control unit 258. An encoder 253 and the option sensor 158 are connected to the option control unit 250 and are configured to detect a rotation state of the separation roller 155. Detection results from these sensors are used by the drive control unit 258 for controlling driving of the pick roller 153. According to a variation example, the top sensor 108 according to the aforementioned embodiments may be replaced by the option sensor 158 to execute the same controls.

According to the first to sixth embodiments, the driving of the pick roller 103 is turned off to control to prevent the pick roller 103 from executing a sheet feeding operation. However, embodiments are not limited thereto. For example, the pick roller 103 may be configured to move between a contact position where it touches a sheet S and a retracted position where it does not touch the sheet S. In this configuration, the pick roller 103 is moved from the contact position to the retracted position at a time when the leading end of the sheet S2 reaches the separation roller 105 to control the pick roller 103 so as not to execute the sheet feeding operation. In other words, the pick roller 103 is isolated from the sheet S. In this case, the driving of the pick roller 103 may be kept in an ON state, that is, the pick roller 103 may be kept rotating.

According to the first to sixth embodiments, it is judged that the sheet S2 reaches the separation roller 105 at a time when the encoder 203 detects that the separation roller 105 stops rotating or rotates in an opposite direction. However, embodiments are not limited thereto. At a time when it is detected that the rotation speed in a forward direction of the separation roller 105 is lower than a predetermined rotation speed, the reach of the sheet S2 to the separation roller 105 may be judged. The forward direction here is a direction in which a sheet S is to be fed. Thus, the driving of the pick roller 103 can be turned off earlier under the second sheet feeding control to control such that the pick roller 103 can be prevented from excessively pushing the leading end of the sheet S2 toward the separation nip Pfr.

According to the first to sixth embodiments, the reach of the sheet S2 to the separation roller 105 is judged based on a detection result of a rotation state of the separation roller 105. However, embodiments are not limited thereto. For the judgment, a double-feed detection sensor configured to detect a double feed of sheets S may be provided in neighborhood of the separation roller 105. Here, the double-feed detection sensor may be an ultrasonic sensor or a transmitted light detection sensor.

According to the first to sixth embodiments, the cassette 102 detachably attached to the printer 101 is applied as an accommodation unit, for example. However, embodiments are not limited thereto. The accommodation unit may be a manual feed tray or a multi-tray capable of inserting a sheet S into the printer 101. The manual feed tray or the multi-tray may be fixed to the printer 101 and may not be detachably attached thereto. In this case, if the second sheet feeding control is executed and the sheet S2 moves and is nipped by the separation nip, there is a possibility that the sheet S2 is damaged when a user replaces sheets S stacked in the manual feed tray or the multi-tray.

While aspects have been described with reference to embodiments, it is to be understood that the invention is not limited to the disclosed embodiments. The scope of the following claims is to be accorded the broadest interpretation to encompass all such modifications and equivalent structures and functions.

This application claims the benefit of Japanese Patent Application No. 2016-055762 filed Mar. 18, 2016, which is hereby incorporated by reference herein in its entirety.

What is claimed is:

1. An image forming apparatus comprising:

a feeding member configured to feed a recording material placed on a tray;

a conveying member configured to convey the recording material fed by the feeding member;

a separating member configured to form a nip with the conveying member and separate a plurality of recording materials at the nip, wherein a feeding operation by the feeding member is ended after a leading end of the recording material reaches at least the conveying member;

a detecting unit configured to detect that the plurality of recording materials is fed to the nip;

an image forming unit configured to form an image on the recording material fed from the tray; and a control unit configured to switch between a first control and a second control, wherein, under the first control, the feeding member starts feeding a recording material placed on the tray, and the feeding operation by the feeding member is ended before a trailing end of the recording material passes through the feeding member, and wherein, under the second control, the feeding member starts feeding a first recording material placed uppermost on the tray, the feeding operation by the feeding member is continued after a trailing end of the first recording material passes through the feeding member to feed a second recording material placed under the first recording material in a state where the first recording material and the second recording material partially overlap, and the feeding operation by the feeding member is ended in a condition that the detection unit detects that the first recording material and the second recording material are fed to the nip.

2. The image forming apparatus according to claim 1, wherein, under the first control, the feeding operation by the feeding member is ended at a point in time when a predetermined time passes from start of feeding of the recording material placed on the tray by the feeding member.

3. The image forming apparatus according to claim 1, further comprising a recording material detecting unit configured to detect whether a recording material has reached a position on a downstream side in a recording-material feeding direction of the nip, wherein, under the first control, the feeding operation by the feeding member is ended based on a point in time when the recording material detecting unit detects the recording material.

4. The image forming apparatus according to claim 3, wherein, under the second control, the feeding operation by the feeding member is ended at a point in time when the detecting unit detects that the first recording material and the second recording material are fed to the nip and the recording material detecting unit detects the first recording material.

5. The image forming apparatus according to claim 4, wherein the control unit causes to feed a recording material placed on the tray under the second control and, in a case where the recording material detecting unit does not detect the recording material until a first threshold time passes from start of feeding of the recording material placed on the tray by the feeding member, the control unit causes to end the feeding operation by the feeding member once and feed the recording material again under the first control.

6. The image forming apparatus according to claim 4, wherein the control unit causes to feed a recording material placed on the tray under the second control, and, in a case where the recording material detecting unit does not detect the recording material until a second threshold time passes from start of feeding of the recording material placed on the tray by the feeding member, the control unit causes to feed the recording material under the first control without ending the feeding operation by the feeding member.

7. The image forming apparatus according to claim 4, further comprising a storage unit configured to store a number of times that the recording material detecting unit does not detect a recording material until a third threshold time passes from start of feeding of the recording material placed on the tray by the feeding member, wherein, in a case where the number of times stored in the storage unit is lower than a predetermined threshold number of times, the control unit causes to feed a recording material under the second control, and wherein, in a case where the number of times stored in the storage unit is higher than the predetermined threshold number of times, the control unit causes to feed a recording material under the first control.

8. The image forming apparatus according to claim 1, wherein, under the second control, the feeding operation by the feeding member is ended at a point in time when the detecting unit detects that the first of recording material and the second recording material are fed to the nip.

9. The image forming apparatus according to claim 1, wherein, in order to feed two or more recording materials continuously from the tray, the control unit switches between the first control and the second control in order of feeding of recording materials from the tray.

10. The image forming apparatus according to claim 9, wherein the control unit, under the second control, causes to feed a recording material that is not a last one in the order of feeding from the tray in one job, and wherein the control unit, under the first control, causes to feed a recording material that is the last one in the order of feeding from the tray in one job.

11. The image forming apparatus according to claim 9, further comprising a first tray and a second tray, wherein the control unit, under the second control, causes to feed a recording material that is not a last one in order of feeding from the first tray in one job among recording materials to be fed from the first tray and feed a recording material that is not a last one in order of feeding from the second tray in one job among recording materials to be fed from the second tray, and wherein the control unit, under the first control, causes to feed a recording material that is a last one in order of feeding from the first tray in one job and feed a recording material that is a last one in order of feeding from the second tray in one job.

12. The image forming apparatus according to claim 1, wherein, in order to feed two or more recording materials continuously from the tray, the control unit switches between the first control and the second control based on an image forming condition for forming the image on the recording material by the image forming unit.

13. The image forming apparatus according to claim 12, wherein, in a case where the image forming condition for the first recording material is identical to the image forming condition for the second recording material, the control unit causes to feed the first recording material under the second control, and wherein, in a case where the image forming condition for the first recording material is different from the image forming condition for the second recording material, the control unit causes to feed the first recording material under the first control.

14. The image forming apparatus according to claim 13, wherein the image forming unit includes an exposing unit configured to irradiate light to a charged image carrier and a fixing unit configured to fix an image transferred from the image carrier to a recording material to the recording material, and wherein the image forming condition includes a speed for feeding a recording material, a quantity of light irradiated from the exposing unit to the image carrier, and a fixing temperature of the fixing unit.

15. The image forming apparatus according to claim 1, wherein, in order to feed one recording material from the tray, the control unit feeds the one recording material under the first control.

16. The image forming apparatus according to claim 1, wherein the control unit causes to stop rotation of the feeding member or separate the feeding member and a recording material placed on the tray to end the feeding operation by the feeding member.

17. The image forming apparatus according to claim 1, wherein, when one recording material is fed to the nip, the separating member is rotated by the one recording material in a predetermined direction, and, when a plurality of recording materials is fed to the nip, the separating member stops rotating or rotates in a direction opposite to the predetermined direction to feed one recording material of the plurality of recording materials and prevent the remaining recording materials from being fed, wherein the detecting unit is a rotation detecting unit configured to detect a rotation state of the separating member, and wherein, in a case where the rotation detecting unit detects that the separating member stops rotating or rotates in the opposite direction, it is detected that the plurality of recording materials is fed to the nip.

18. The image forming apparatus according to claim 1, further comprising a second conveying member configured to convey the recording material conveyed by the conveying member, wherein the feeding operation by the feeding member is ended after the leading end of the recording material reaches the second conveying member, and the second conveying member conveys the recording material after the feeding operation by the feeding member is ended.

19. The image forming apparatus according to claim 1, wherein the control unit switches between the first control and the second control in a state where a plurality of recording materials is placed on the tray.

20. A feeding device comprising:

a feeding member configured to feed a recording material placed on a tray;

a conveying member configured to convey the recording material fed by the feeding member;

a separating member configured to form a nip with the conveying member and separate a plurality of recording materials at the nip, wherein a feeding operation by the feeding member is ended after a leading end of the recording material reaches at least the conveying member;

a detecting unit configured to detect that the plurality of recording materials is fed to the nip; and a control unit configured to switch between a first control and a second control, wherein, under the first control, the feeding member starts feeding a recording material placed on the tray, and the feeding operation by the feeding member is ended before a trailing end of the recording material passes through the feeding member, and wherein, under the second control, the feeding member starts feeding a recording material placed uppermost on the tray, the feeding operation by the feeding member is continued after a trailing end of the first recording material passes through the feeding member to feed a second recording material placed under the first recording material in a state where the first recording material and the second recoding material partially overlap, and the feeding operation by the feeding member is ended in a condition that the detection unit detects that the first recording material and the second recording material are fed to the nip.

21. The feeding device according to claim 20, wherein, under the first control, the feeding operation by the feeding member is ended at a point in time when a predetermined time passes from start of feeding of the recording material placed on the tray by the feeding member.

22. The feeding device according to claim 20, further comprising a recording material detecting unit configured to detect whether a recording material has reached a position on a downstream side in a recording-material feeding direction of the nip, wherein, under the first control, the feeding operation by the feeding member is ended based on a point in time when the recording material detecting unit detects the recording material.

23. The feeding device according to claim 20, wherein, under the second control, the feeding operation by the feeding member is ended at a point in time when the detecting unit detects that the first recording material and the second recording material are fed to the nip.

24. The feeding device according to claim 20, wherein the control unit causes to stop rotation of the feeding member or separate the feeding member and a recording material placed on the tray to end the feeding operation by the feeding member.

25. The feeding device according to claim 20, wherein, when one recording material is fed to the nip, the separating member is rotated by the one recording material in a predetermined direction, and, when a plurality of recording materials is fed to the nip, the separating member stops rotating or rotates in a direction opposite to the predetermined direction to feed one recording material of the plurality of recording materials and prevent the remaining recording materials from being fed, wherein the detecting unit is a rotation detecting unit configured to detect a rotation state of the separating member, and wherein, in a case where the rotation detecting unit detects that the separating member stops rotating or rotates in the opposite direction, it is detected that the plurality of recording materials is fed to the nip.

26. The feeding device according to claim 20, further comprising a second conveying member configured to convey the recording material conveyed by the conveying member, wherein the feeding operation by the feeding member is ended after the leading end of the recording material reaches the second conveying member, and the second conveying member conveys the recording material after the feeding operation by the feeding member is ended.

27. The feeding device according to claim 20, wherein the control unit switches between the first control and the second control in a state where a plurality of recording materials is placed on the tray.

28. A feeding device comprising:

a feeding member configured to feed a recording material placed on a tray;

a first conveying member configured to convey the recording material fed by the feeding member;

a separating member configured to form a nip with the first conveying member and separate a plurality of recording materials at the nip;

a second conveying member configured to convey the recording material conveyed by the first conveying member;

a detecting unit configured to detect that the plurality of recording materials is fed to the nip; and a control unit configured to switch between a first control and a second control, wherein, under the first control, the feeding member starts feeding a recording material placed on the tray, and the feeding operation by the feeding member is ended after a leading end of the recording material reaches the second conveying member and before a trailing end of the recording material passes through the feeding member, and wherein, under the second control, the feeding member starts feeding a first recording material placed uppermost on the tray, the feeding operation by the feeding member is continued after a trailing end of the first recording material passes through the feeding member to feed a second recording material placed under the first recording material in a state where the first recording material and the second recording material partially overlap, and the feeding operation by the feeding member is ended after a leading end of the first recording material reaches the second conveying member and in a condition that the detection unit detects that the first recording material and the second recording material are fed to the nip.

29. The feeding device according to claim 28, wherein the control unit causes to stop rotation of the feeding member or separate the feeding member and a recording material placed on the tray to end the feeding operation by the feeding member.

30. The feeding device according to claim 28, wherein, when one recording material is fed to the nip, the separating member is rotated by the one recording material in a predetermined direction, and, when a plurality of recording materials is fed to the nip, the separating member stops rotating or rotates in a direction opposite to the predetermined direction to feed one recording material of the plurality of recording materials and prevent the remaining recording materials from being fed, wherein the detecting unit is a rotation detecting unit configured to detect a rotation state of the separating member, and wherein, in a case where the rotation detecting unit detects that the separating member stops rotating or rotates in the opposite direction, it is detected that the plurality of recording materials is fed to the nip.

31. The feeding device according to claim 28, wherein the control unit switches between the first control and the second control in a state where a plurality of recording materials is placed on the tray.

* * * * *